US010657759B2

(12) United States Patent
Berman et al.

(10) Patent No.: US 10,657,759 B2
(45) Date of Patent: May 19, 2020

(54) GAMING SYSTEMS, APPARATUSES AND METHODS FOR PROVIDING A CONDITIONAL REPLAY FOR A SUBSET OF A GAME PLAY AREA

(71) Applicant: KING SHOW GAMES, INC., Minnetonka, MN (US)

(72) Inventors: Bradley Berman, Minnetonka, MN (US); Jacob Lamb, Maple Grove, MN (US)

( * ) Notice: Subject to any disclaimer, the term of this patent is extended or adjusted under 35 U.S.C. 154(b) by 199 days.

(21) Appl. No.: 15/794,304

(22) Filed: Oct. 26, 2017

(65) Prior Publication Data

US 2018/0130286 A1 May 10, 2018

Related U.S. Application Data

(60) Provisional application No. 62/419,404, filed on Nov. 8, 2016.

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/3209* (2013.01); *G07F 17/3244* (2013.01); *G07F 17/3267* (2013.01); *G07F 17/34* (2013.01)

(58) Field of Classification Search
None
See application file for complete search history.

(56) References Cited

U.S. PATENT DOCUMENTS

| | | | |
|---|---|---|---|
| 5,704,835 | A | 1/1998 | Michael |
| 6,129,632 | A | 10/2000 | Luciano |
| 6,939,223 | B1 | 9/2005 | Jones |
| 6,942,567 | B2 | 9/2005 | Baerlocher et al. |
| 7,252,589 | B1 | 8/2007 | Marks et al. |
| 7,393,278 | B2 | 7/2008 | Gerson et al. |
| 7,465,229 | B2 | 12/2008 | Shuster |
| 7,559,836 | B2 | 7/2009 | Gerson et al. |
| 7,674,180 | B2 | 3/2010 | Graham et al. |
| 7,713,123 | B2 | 5/2010 | Gerson et al. |
| 7,892,081 | B2 | 2/2011 | Glavich et al. |
| 8,376,829 | B2 | 2/2013 | Nores |
| 8,480,482 | B2 | 7/2013 | Walker et al. |
| 8,517,813 | B2 | 8/2013 | Berman et al. |

(Continued)

OTHER PUBLICATIONS

Vegas Slots Online "Reel Respin Slot Feature", www.vegasslotsonline.com, dated Mar. 2017.

*Primary Examiner* — Jason T Yen

(57) ABSTRACT

Systems, apparatuses and methods to facilitate a conditional replay of some portion of the game elements used in playing a wagering game. In a representative slot game embodiment, symbols are presented in a grid, and a symbol location(s) is randomly identified for symbol substitution. If it is determined that any one or more available candidate substitute symbols could create or improve a result on a payline on which the randomly identified symbol location resides, a substitute symbol is selected from the candidate substitute symbols and substituted at the randomly identified symbol location. Other embodiments include, for example, dynamically creating the available candidate substitute symbols based on other symbols on the payline.

17 Claims, 13 Drawing Sheets

(56) References Cited

U.S. PATENT DOCUMENTS

| | | | | |
|---|---|---|---|---|
| 8,636,585 | B2 | 1/2014 | Shuster | |
| 8,758,115 | B2 | 6/2014 | Roemer et al. | |
| 2006/0264255 | A1 | 11/2006 | Borissov | |
| 2006/0281531 | A1 | 12/2006 | Takeda | |
| 2007/0232382 | A1 | 10/2007 | Berman | |
| 2007/0254735 | A1 | 11/2007 | Marks et al. | |
| 2008/0214267 | A1* | 9/2008 | Ghaly | G07F 17/32 463/17 |
| 2009/0104970 | A1* | 4/2009 | Nishimura | G07F 17/3202 463/20 |
| 2010/0298042 | A1 | 11/2010 | Berman et al. | |
| 2011/0151957 | A1 | 6/2011 | Falciglia | |
| 2011/0269538 | A1 | 11/2011 | Malice et al. | |
| 2012/0322532 | A1 | 12/2012 | Nauman | |
| 2014/0018147 | A1* | 1/2014 | Gobe | G07F 17/34 463/20 |
| 2014/0141859 | A1 | 5/2014 | Shuster | |
| 2014/0221079 | A1* | 8/2014 | Rucker | G07F 17/3267 463/21 |
| 2014/0357342 | A1 | 12/2014 | Elias | |
| 2017/0092048 | A1 | 3/2017 | Fujisawa et al. | |
| 2017/0213415 | A1* | 7/2017 | Nakamura | G07F 17/3213 |

* cited by examiner

GAMING SYSTEMS, APPARATUSES AND METHODS FOR PROVIDING A CONDITIONAL REPLAY FOR A SUBSET OF A GAME PLAY AREA

FIELD

This disclosure relates generally to games, and more particularly to gaming systems, apparatuses and methods to facilitate a conditional replay of some portion of the game elements used in playing the game.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to facilitate a conditional replay of some portion of the game elements used in playing the game.

In one embodiment, a slot game apparatus is provided, which includes at least a display, user interface, wager input device, and processor. The display presents a symbol array having multiple symbol locations in which symbols may be presented. The user interface includes at least one user input to allow a player to initiate a slot game event presented via the symbol array. The wager input device of this embodiment is structured to identify and validate player assets, and to permit the player to play the slot game event when the player assets are provided. The processor is configured to present symbols in the symbol locations of the symbol array, randomly designate one of the symbol locations as a target symbol location, determine whether any candidate substitute symbols associated with a set of the candidate substitute symbols could improve a result of the slot game event if substituted at the target symbol location, randomly select one of the candidate substitute symbols from the set of candidate substitute symbols if it is determined that any of the candidate substitute symbols could improve the result, and substitute the randomly selected one of the candidate substitute symbols at the target symbol location.

In one particular embodiment of such an apparatus, the processor is further configured to determine the result of the slot game event by analyzing combinations of the symbols and the randomly selected one of the candidate substitute symbols on one or more paylines that involve the target symbol location. In another embodiment, the processor is configured to determine whether any of the candidate substitute symbols could improve the result of the slot game event by determining whether any of the candidate substitute symbols, if substituted at the target symbol location, would change a first symbol combination that does not correspond to a predetermined winning symbol combination to a second symbol combination that does correspond to a predetermined winning symbol combination. Another alternative embodiment of such an apparatus involves the configured processor determining whether any of the candidate substitute symbols could improve the result of the slot game event by determining whether any of the candidate substitute symbols, if substituted at the target symbol location, would change a first symbol combination that corresponds to a first predetermined winning symbol combination having a first payout value to a second symbol combination that corresponds to a second predetermined winning symbol combination having a second payout value higher than the first payout value.

Still other embodiments of such an apparatus include the processor being configured to randomly designate one of the symbol locations as a target symbol location by presenting via the display a predefined symbol at the target symbol location, where in other embodiments the processor may be configured to randomly designate one of the symbol locations as a target symbol location by distinguishing the target symbol location from others ones of the symbol locations.

Other embodiments of such an apparatus relate to the candidate substitute symbols that are used as potential symbol substitutions for game grid replay. For example, the processor may be configured to create the set of the candidate substitute symbols as a static set of the candidate substitute symbols that does not change between slot game events, where in another embodiment the processor may be configured to randomly create the set of the candidate substitute symbols anew for each of a plurality of the slot game events. In one particular embodiment, the processor is configured to randomly designate at least one additional one of the symbol locations as additional target symbol locations, determine whether any candidate substitute symbols associated with the set of the candidate substitute symbols could improve additional results of the slot game event if substituted at the respective additional target symbol locations, and for each of the additional target symbol locations, randomly select one of the candidate substitute symbols from the set of candidate substitute symbols if it is determined that any of the candidate substitute symbols could improve the additional results, and substitute the randomly selected ones of the candidate substitute symbols at the respective ones of the target symbol locations.

In another embodiment, a slot game device is provided that includes a display to present multiple symbol locations forming a symbol array, a user interface with at least one user input to facilitate a player's initiation of a slot game event (e.g., reel spin, poker hand, etc.) presented via the symbol array, a wager input device structured to identify and validate player assets and to permit the player to play the slot game event when the player assets are provided, and a processor to carry out operations. In this embodiment, the processor is configured to present symbols in the symbol locations of the symbol array, designate one of the symbol locations as a target symbol location, analyze a payline that passes through the target symbol location to identify at least one substitute symbol that would benefit the payline if positioned at the target symbol location, provide a set of candidate substitute symbols that includes the at least one substitute symbol that would benefit the payline, randomly select a substitute symbol from the set of candidate substitute symbols, present the selected substitute symbol at the target symbol location, and analyze the payline to determine an outcome.

In more particular embodiments of such a slot game device, designating one of the symbol locations involves randomly designating one of the symbol locations as the target symbol location. In a representative alternative embodiment, designating one of the symbol locations involves analyzing the symbols on the symbol array to identify a group of the symbols on the payline that need one more of the symbols on a particular symbol location to create or increase a payout on the payline, and designating that symbol location as the target symbol location.

In another particular embodiment of such a slot game, the processor is configured to analyze a plurality of paylines that pass through the target symbol location to identify at least one substitute symbol that would benefit one or more of the plurality of paylines if positioned at the target symbol location, and to provide the set of candidate substitute symbols that includes the at least one substitute symbol that would benefit one or more of the plurality of paylines.

Still other representative embodiments of such a slot game involve the configured processor providing at least one of the candidate substitute symbols that would cause the outcome to change from non-winning outcome to a winning outcome, or alternatively would cause the outcome to change from first level result to a second level result where the second level result has a higher monetary value than the first level result.

In another embodiment, the processor is configured to analyze the payline by comparing predetermined winning symbol combinations to symbols on the payline, and to identify one or more candidate substitute symbols that would complete any of the predetermined winning symbol combinations. In another embodiment, the processor is configured to designate a designating a target symbol location comprises presenting a special symbol at the target symbol location.

In another embodiment, a gaming method is provided that includes presenting symbols in respective symbol locations of a symbol array, randomly identifying a symbol location as a substitution candidate, and determining whether any candidate substitute symbols could improve a result on a payline that includes the symbol location identified as the substitution candidate. If it is determined that any of the candidate substitute symbols could improve a result on the payline that includes the symbol location identified as the substitution candidate, then the processor guides a random selection from the candidate substitute symbols, and replaces an existing symbol at symbol location identified as the substitution candidate with the randomly selected candidate substitute symbol.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
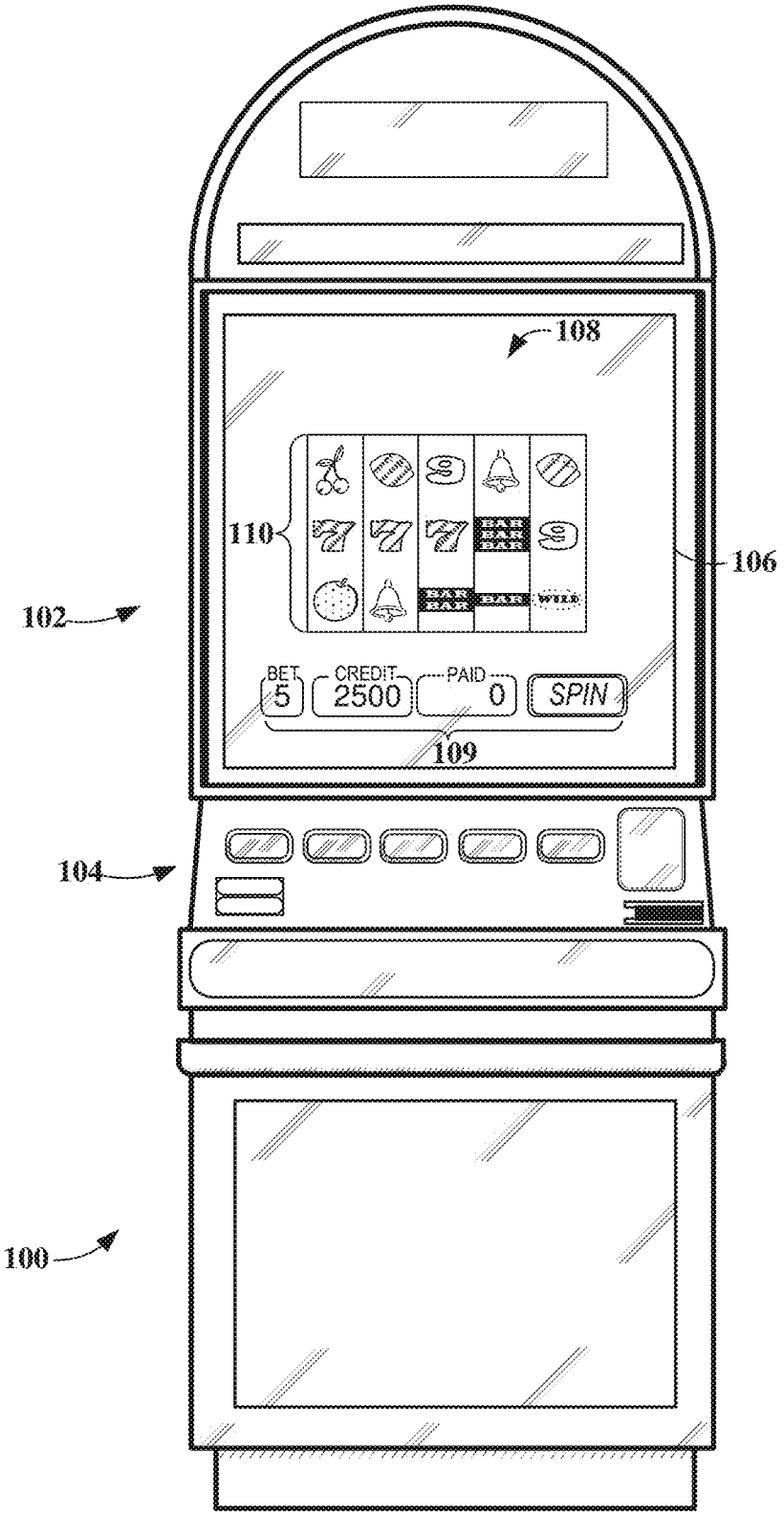
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for facilitating a conditional replay of some portion of the game elements used in playing the game. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments described herein include providing gaming devices (also referred to as gaming apparatuses or gaming machines), gaming systems, and methods of operating these devices or systems to provide game play involving conditionally replaying some portion of the game elements used to participate in a game. For example, in the context of a slot game, the game elements include the symbols presented at respective symbol locations. The symbol(s) presented in one or more of the symbol locations may, under certain conditions, be replaced by a substitute symbol(s) to provide a second chance to obtain or to improve an award. Conditions under which such a second chance is provided may vary, and in some embodiments include an indicator to identify candidate symbols for replacement, and/or provide an analysis of potential outcomes to determine whether any of the potential outcomes meet some criteria, such as enabling or improving an award relative to the initial random positioning of the symbols.

Slot game or analogous random symbol game embodiments therefore may include respinning individual game element locations within a game grid. In one embodiment, a game grid includes a plurality of element locations where a portion of game symbols on a plurality of game reels are displayed and evaluated as part of a gaming event outcome. Here, when a special symbol, a symbol marked with a subsymbol, or a symbol otherwise indicated as activatable appears on the game grid as part of a game outcome, that element location may be treated as an independent reel and is spun for the chance at a new value, which may help the game outcome. In some embodiments, the special symbol is only treated as an independent reel when a new symbol in that location would help or otherwise enhance the evaluation of the game grid. In some embodiments, the independent reel is formed with more (or only) symbols that can help increase pays when evaluating the game grid for awards.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
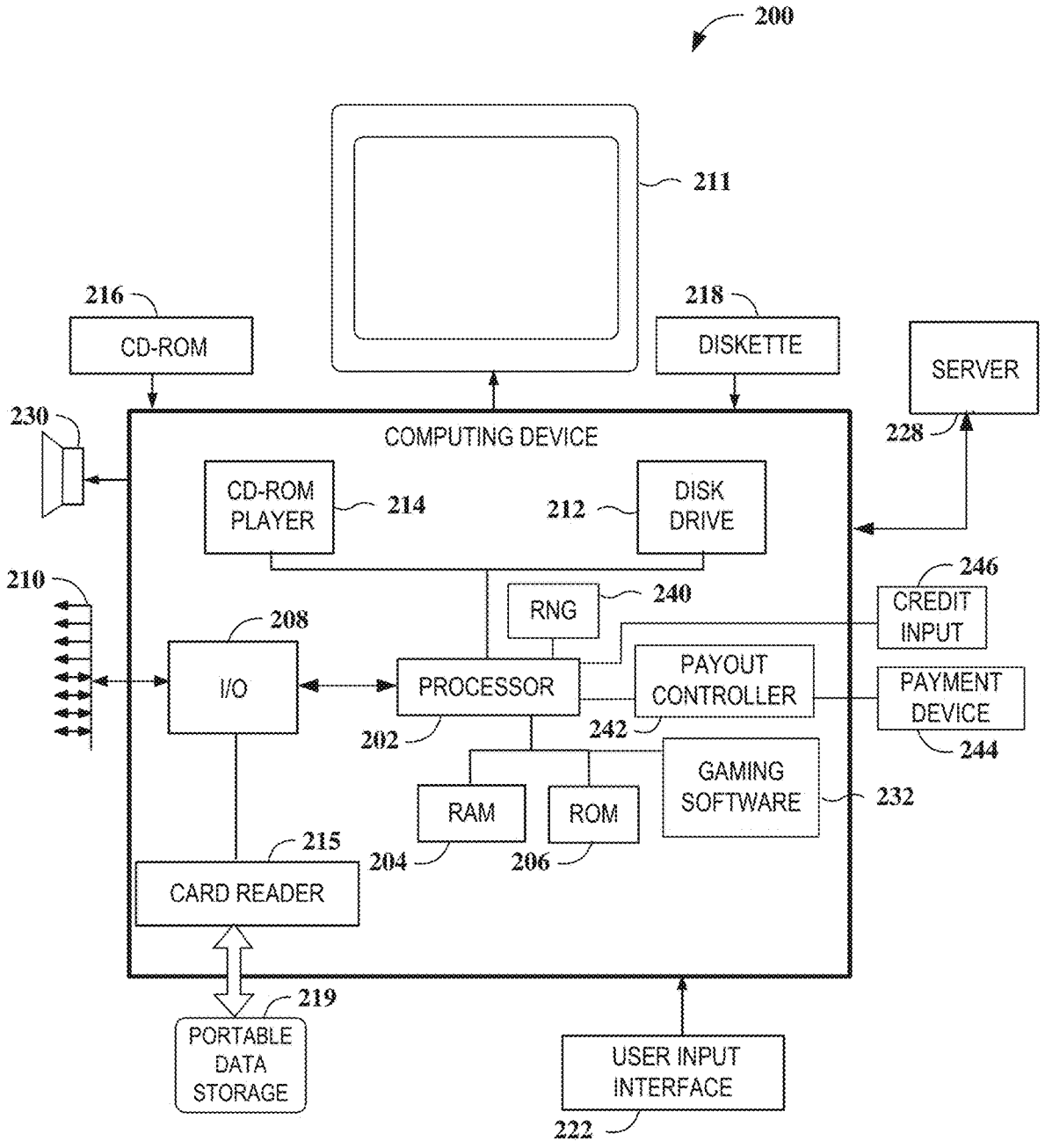
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments described herein, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, a game is provided that randomly facilitates an opportunity to update a symbol(s) at a respective symbol location(s) when one or more conditions are met. Examples of such conditions include, for example, whether a symbol location(s) has been identified as a candidate for such an update opportunity, and/or whether the symbol update options could potentially cause or improve a winning result. Thus, embodiments include gaming systems and methods that provide a conditional replay of one or more constituents of the game in an attempt to enhance or otherwise alter a gaming result.

Many embodiments may be described in terms of a slot game, where symbols are matched on paylines to determine payout awards. However, the principles described herein are equally applicable to other games of chance, as described herein and as will be readily apparent to those skilled in the art from the teachings herein. In a representative slot game embodiment, a determination is made whether a special symbol (and/or other symbol/symbol location identifier) occurs in the game, and if so, the location of the special symbol may be activated if a predetermined condition(s) is met. For example, the symbol location of the special symbol may be activated in the sense that it will be allowed to randomly receive a substitute symbol, if the available substitute symbols include an opportunity to generate or enhance a payout and/or feature trigger. In one embodiment, one of the available substitute symbols is randomly selected as the substitute symbol, such as by providing a special reel with the available substitute symbols at that activated symbol location, or by using any other random selection methodology (e.g., look-up table; use of a random number generator; etc.). Unless otherwise noted, reference herein to selection via a "reel" includes any random selection process. In some embodiments, the special reel includes a specific subset of the symbols of the primary reels or other primary symbol collection, such as a rich reel with one or more of high-value symbols, bonus triggers, scatter symbols, payout modifiers (e.g., multipliers and/or other mathematical enhancements), etc. In other embodiments, the special reel is dynamically configured to include at least one symbol capable of random selection that will improve the result based on the particular context in which the feature arose, such as based on the symbols on the payline of the randomly presented special symbol. These and other representative embodiments are described below such that one of ordinary skill in the art can readily understand the inventive concepts which could be applied to these and other analogous embodiments.

As discussed above, embodiments of the present concept include providing systems, apparatuses and methods for operating these systems/apparatuses to provide game play that utilizes operations of respinning individual game element locations within a game grid. In one embodiment, a game grid includes a plurality of element locations where a portion of game symbols on a plurality of game reels are displayed and evaluated as part of a gaming event outcome. Here, when a special symbol, a symbol marked with a subsymbol, or a symbol otherwise indicated as activatable appears on the game grid as part of a game outcome, that element location is treated as an independent reel and is spun for the chance at a new value, which may help the game outcome. In some embodiments, the special symbol is only treated as an independent reel when a new symbol in that location would help or otherwise enhance the evaluation of the game grid. In some embodiments, the independent reel is formed with a greater number of (or only) symbols that can help increase pays when evaluating the game grid for awards.

In some embodiments, one or more of the regular base game reel strips include a special symbol, which could be presented as a symbol that is unique and/or otherwise signifies triggering of the grid element respin function (e.g., a question mark symbol). When the reels have stopped spinning, if any such special symbol(s) is present on the game grid, the game grid is evaluated to see if one of the available substitute symbols would create or enhance a pay if it was placed in the location of the special symbol. In one embodiment, the available substitute symbols include:

Bonus trigger symbol
Scatter Symbol
Wild (2×, 3×, 5×, 10×)
(Any other symbol type that would be deemed valuable in the game)

If it is determined that any of the substitute symbols would create or enhance a pay, then in one embodiment the symbol location of the special symbol animates and is spun as an independent reel with reel strips that may include some of the symbols listed above, or consist entirely of the symbols described above.

In embodiments where certain symbol combinations occur, a Wild Card Symbol Window may open at key symbol locations and spin a custom reel to create or enhance payouts. In one example using a 5-column, 3-row grid, the player spins the reels and receives a four-symbol payout, e.g., M1 symbol payout, on a particular payline (e.g., payline 15), where M1 represents some particular symbol in the game (e.g., a high value symbol). In this particular example, the reel 5 position of this payline (e.g., payline 15), a Wild Card Symbol Window opens and spins an independent reel that contains only the following symbols:

M1 with no multiplier
M1 with a 2× multiplier
M1 with a 3× multiplier
M1 with a 5× multiplier In another representative example, a player spins the reels and receives a three-symbol B1 trigger on a particular payline (e.g., payline 15), where B1 represents a bonus symbol in the game. In the reel 5 position of payline 15, a Wild Card Symbol Window may open and spin an independent reel that contains only the following symbols:

B1 with no multiplier
B1 with a 2× multiplier
B1 with a 3× multiplier
B1 with a 5× multiplier Here, any resulting multiplier would be applied to the resulting bonus. In another example, the Wild Card Symbol Window may be opened anywhere as a result of the requisite number of bonus symbols (e.g., three), and randomly provides a multiplier or other modifier to apply to the result of the bonus round.

These and other representative embodiments are described in various examples below.

Figure 3A:
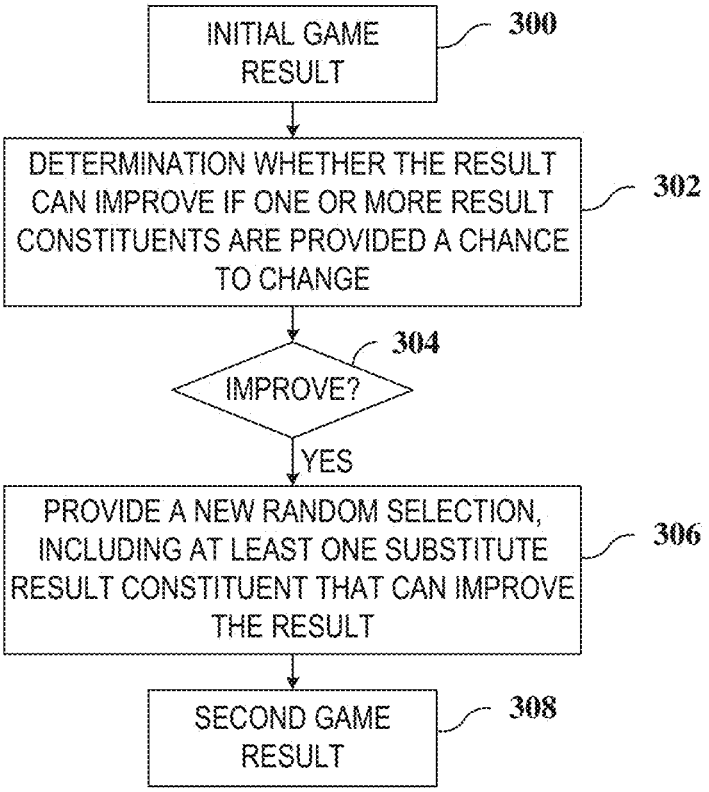
FIGS. 3A and 3B are flow diagrams generally depicting representative embodiments of a game that provides a conditional replay of a subset of the game play elements.

FIG. 3A is a flow diagram generally depicting one embodiment of a game that provides a conditional replay of a subset of the game play elements. An initial game result 300 is provided, such as an initial spin of the reels in a slot game, an initial deal in a poker game, an initial set of numbers in a keno game, etc. In the illustrated embodiment, a determination 302 is made as to whether the result could improve if one or more of the result constituents was provided a chance to change. For example, in a slot game embodiment, the result constituents may take the form of presented symbols or other indicia, such as symbols on a plurality of physical or virtual/electronic reels. If it is determined that there is a chance that the result (e.g., payline symbol combination) can improve if the particular symbol (s) was to change as determined at decision block 304, then a new random selection is provided 306, which includes at least one substitute result constituent that could improve the results. For example, the new random selection may include a plurality of slot symbols, such as on a physical or virtual reel, lookup table, etc. If at least one of the plurality of slot symbols associated with the new random selection could create a winning payline result or enhance the existing payline result, the new random selection is made, and the resulting symbol is substituted for the symbol previously at the symbol location. This provides a second game result 308, which may or may not have created or improved a winning result, depending on the result of the new random selection.

In some embodiments, the process of FIG. 3A may be repeated one or more additional times, to provide a third game result, fourth game result, etc. For example, after the second game result 308, it may again be determined 302 whether the result can further improve if one or more result constituents are provided a chance to change, and if so (decision block 304), another new random selection may be provided 306 that includes at least one substitute result constituent that can improve a third result. Thus, a gaming device operable via a methodology described in FIG. 3A, and as described elsewhere herein, may be performed multiple times if desired.

In the embodiment of FIG. 3A, there was at least a chance of creating a winning result or enhancing the existing result by conditionally replaying one or more of the symbol locations and consequently replacing the respective symbol (s) in the one or more symbol locations. As described in greater detail below, in some embodiments the new random selection is populated with symbols that will all create or enhance a favorable gaming event result, but to different degrees depending on which of the substitute symbols is randomly selected.

Figure 3B:
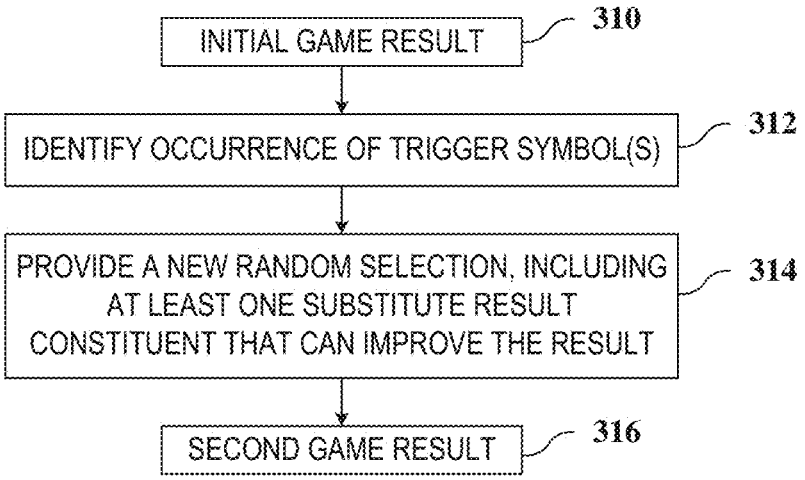

FIG. 3B is a flow diagram generally depicting another embodiment of a game that provides a conditional replay of a subset of the game play elements. In this embodiment, an initial game result 310 is provided, such as an initial spin of the reels in a slot game, an initial deal in a poker game, an initial set of numbers in a keno game, etc. The occurrence of any trigger symbols are identified 312. For example, in the context of a slot game, a trigger symbol(s) may be randomly presented that identifies the location of where a new symbol may substitute for the existing trigger symbol, and the presence of such a trigger symbol is identified 312. A new random selection is provided 314, that includes a plurality of substitute symbol candidates, with at least one of such candidate substitute symbols being capable of causing or improving a winning result that implicates the symbol location of the trigger symbol. Upon selecting one of the plurality of candidate symbols, a second game result is presented as depicted at block 316. Such an embodiment has a condition that a trigger symbol(s) occurred, but does not include the condition in FIG. 3A where the new random selection is provided if it is first determined that the second game result can change to a winning result or an improved winning result. In yet another embodiment related to the embodiment of FIG. 3B, the new random selection need not be provided with at least one candidate substitute symbol that is known to create or improve a winning result, but rather may include candidate substitute symbols that might not create or improve a winning result in the particular slot game scenario.

As described in greater detail below, a trigger symbol(s) may be randomly positioned in a gaming grid to identify the target location(s) of a substitute symbol. In other embodiments, a trigger symbol or other trigger activity initiates the features set forth herein, but the target location(s) may be at one or more grid locations that do not coexist with the trigger symbol. In one embodiment, a trigger initiates the feature, but the target location(s) for symbol replacement may be strategically selected, such as to benefit the player when a gaming result could create or improve a result by enabling that target location(s) to update the symbol associated therewith. For example, if there is a gap in a symbol combination on a payline, such as a single missing symbol to complete the symbol combination such that it creates a winning payout on that payline, the grid position that would involve the change may be dynamically selected as the target location. In this manner, the target location may be determined based on an analysis of surrounding or otherwise relevant symbols on paylines or otherwise (e.g., 2 of 3 symbols present for a 3-symbol scatter pay). The particular symbol location that becomes the target of the possible symbol replacement may therefore be strategic based on an analysis, rather than merely a random selection of a symbol location. Further, in some embodiments, the candidate substitute symbols available for such a strategically-selected symbol location are set to include at least one symbol, and in some cases all symbols, that will "fill the gap" for that particular symbol combination at the target location(s).

Figure 4A:
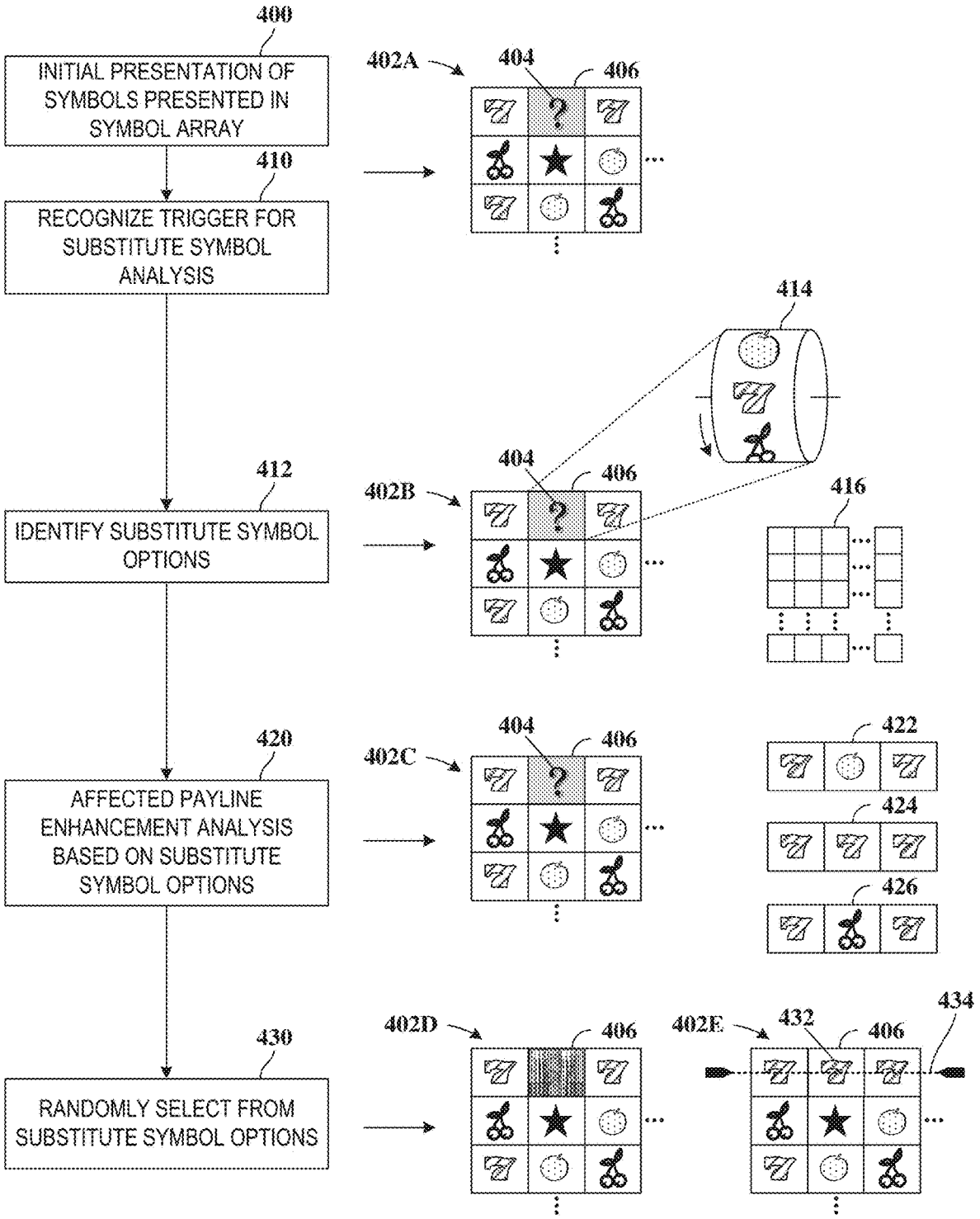
FIGS. 4A and 4B illustrate representative embodiments of conditional replay features in the context of a slot game.

FIG. 4A illustrates a representative embodiment of a conditional replay feature in the context of a slot game. An initial presentation of symbols is presented in a symbol array or grid, as shown at block 400. An example is shown at symbol array 402A, which depicts a grid of indeterminate size, with symbols presented in each of the symbol locations in this example. In accordance with embodiments of the disclosure, some triggering event may occur in connection with a gaming event (e.g., a reel spin in the slot game) to initiate the replay/respin feature described herein. The trigger may be indicated by any visual indicia, audio indication, etc. In the embodiment of FIG. 4A, the trigger is represented by a special symbol 404 at symbol location 406, which is a question mark symbol in the present example. The system recognizes 410 that the trigger has occurred, which indicates the possibility of obtaining an opportunity to substitute a new symbol at the specified symbol location 406.

The trigger symbol(s) 404 may be presented completely randomly, such that the presentation of the trigger symbol is random as to when and where it is presented on the symbol array 402A. In another embodiment, the trigger symbol(s) 404 may occur at random times, but when it occurs it may be at a particular symbol location, such as a symbol location that causes a "gap" in an associated payline that could be filled by a substitute symbol to potentially create or enhance a result on that payline. A "gap" may represent a symbol in a corresponding symbol location that does not conform to an otherwise favorable result. Examples include a non-conforming symbol in an otherwise string of like symbols, a non-confirming symbol to round out the requisite number of like symbols for bonuses, free spins, and/or other gaming features. In another embodiment, the trigger symbol may occur each time a gap in a payline occurs where a substitute symbol could create a winning payout at a particular threshold or higher. In still other embodiments, the trigger symbol only occurs at one or more predetermined symbol locations, and may randomly occur at that position(s) or may occur when the surrounding situation (e.g., other symbols in the pertinent payline(s)) warrants its presentation. In still other embodiments, the trigger symbol(s) may be presented routinely or periodically, within some time duration or play count, in a pattern of occurrence or location, always at some location(s), on only one or more particular reels or locations, etc. The principles described herein are operable regardless of the particular manner in which the trigger symbol(s) is presented.

The substitute symbol options are identified 412 in the illustrated embodiment. The candidate substitute symbols may be preset for each such opportunity, or may be randomly selected each time, or dynamically changed depending on the slot game situation, etc. In any event, the candidate symbols to replace the trigger symbol 404 at symbol location 406 in the present example may be provided in any desired fashion, such as via a substitute virtual or physical reel 414, lookup table 416, etc. In one embodiment, the candidate substitute symbols include at least one symbol which, if selected, would cause the symbol combination on the associated payline to be more favorable in terms of a payout or other award. This may require a dynamic set of candidate substitute symbols (based on the other symbols in that payline) to be created in response to the identification 412 of the trigger symbol 404 and its symbol location 406. Other embodiments may involve candidate substitute symbols which by chance have no symbol that would make the final outcome more favorable, while in still other embodiments some or all of the candidate substitute symbols may make the final outcome more favorable. In other embodiments, the candidate substitute symbols may have preset symbols, but where at least one of those symbols would increase the chances of a favorable outcome, such as a wild symbol, etc.

In the illustrated example, an analysis 420 of the affected payline(s) is conducted to determine whether the affected payline can be improved by at least one of the candidate substitute symbols available. In this embodiment, this is performed as a condition of providing a substitute symbol. For example, in one embodiment, if replacing the symbol 404 at the symbol location 406 with any of the candidate substitute symbols would not improve the result, then the symbol substitution process is not valuable, and is not performed. On the other hand, if any of the candidate substitute symbols would improve the result if selected, this condition is met and the symbol substitution process continues.

To perform such an analysis 420, the candidate substitute symbols are known at the time of conducting the analysis 420, whether due to the candidate substitute symbols being predefined and static, or randomly set prior to the analysis 420. The symbol array 402C is analyzed 420 to determine whether any of the candidate substitute symbols (such as those available on the substitute reel 414, lookup table 416, etc.) will improve a result on one or more paylines that include the symbol location 406 identified by the trigger symbol 404 or other indicator designating the symbol location 406. For purposes of illustration, the embodiment assumes that the only payline including the symbol location 406 is a payline including the symbol locations in the top row of the symbol array 402C (e.g., 7?7 symbols). Each of the candidate substitute symbols can be substituted into the symbol location 406, as depicted at potential payline results 422, 424, 426, to determine whether any of the candidate substitute symbols will improve the payline result. In an embodiment where at least one of the candidate substitute symbols must improve the payline result, potential payline result 424 would result in three "7" symbols on the top row payline, thereby meeting the criteria.

The process involves randomly selecting 430 from the candidate substitute symbols to identify a substitute symbol. In one embodiment, a transitional display may be provided during this selection process, such as the appearance of a spinning reel at the relevant symbol location 406, as depicted by the symbol array 402D. Upon completion of the selection, the selected substitute symbol is presented in the symbol location 406 as depicted at symbol array 402E. In this example, the selected symbol is a "7" symbol 432, which results in a string of three "7" symbols on payline 434. In this example the random selection 430 resulted in an improvement to the original payline. Other candidate substitute symbols could have been presented in the symbol location 406 that would not have improved the result, but in the illustrated embodiment there was at least one candidate substitute symbols that would improve the result, and that candidate substitute symbols was selected 430.

As noted above, features described herein may be triggered by a randomly positioned symbol(s) or otherwise at a randomly identified symbol location(s), or may be triggered based on the context or situation of the game play area (e.g., slot grid). The trigger may occur at random times and/or at a random location(s). It may also occur at particular times, such as periodically, within a range of gaming events, when another event(s) occurs, etc. The trigger may also occur when the context or situation of the game play indicates it may be a favorable time to replace a particular symbol(s), where this could occur always, sometimes, randomly, etc. For example, an analysis of a slot grid context after a reel spin event may occur, and if a symbol location(s) is identified as a location where a winning outcome (or improved winning outcome) would occur if the symbol at that symbol location(s) was to change, then that symbol location may be identified as a place of potential symbol replacement. The analysis itself may occur always, with every possible "gap" or potential winning event, or may occur randomly, or when the spin has been randomly selected for possible symbol replacement, etc. The offer to replace the symbol at that location may, in some embodiments, occur every time such a situation is identified, randomly, periodically, within a range of gaming events, when another event(s) occurs, etc.

Figure 4B:
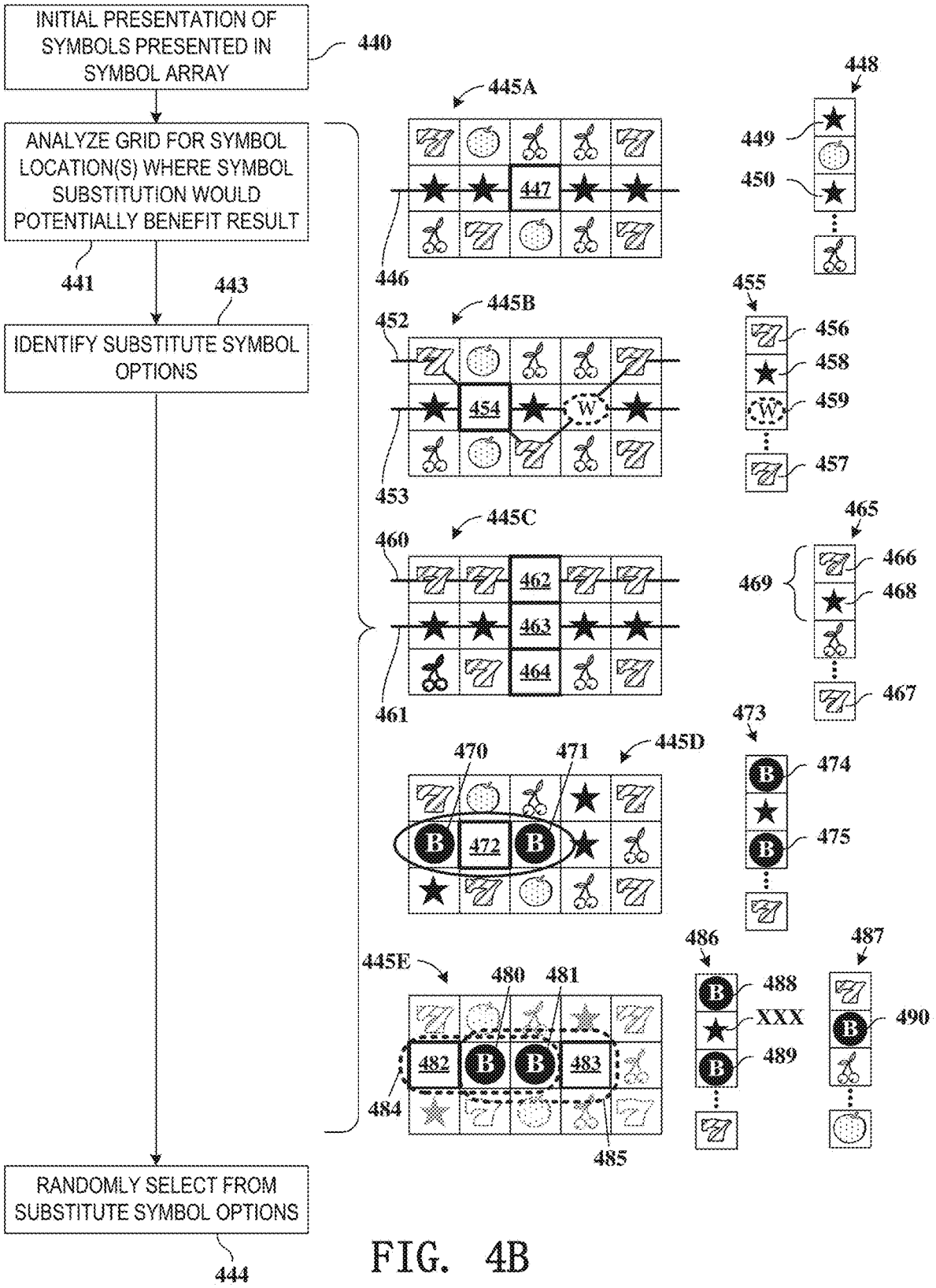

FIG. 4B illustrates representative embodiments of a conditional replay feature in the context of a slot game, where the context of the state of the game is considered in triggering the replay feature and/or which candidate substitute symbols will be utilized. An initial presentation of symbols is presented 440 in a symbol array or grid 445A that has been populated with game symbols. In one embodiment, the grid 445A is analyzed 441 to determine one or more places (e.g., symbol locations, reels, etc.) where symbol substitution would potentially benefit the result. The analysis 441 may discover, among other possibilities, that within grid 445A is a payline 446 that has a "gap" of some number of symbols that could produce a winning result if a different one or more symbols was positioned at that location(s). In this example, four-star symbols are positioned on payline 446, and if a star symbol, wild symbol, etc. was made available at symbol location 447, a winning result would occur. Therefore, symbol location 447 is selected as the location to provide a substitute symbol in this embodiment.

To provide this potential opportunity, candidate substitute symbols are derived based on the particular payline 446 context. For example, the representative replacement reel strip 448 may be dynamically created to include at least one symbol that would satisfy a winning condition on payline 446, such as a star symbol or wild symbol. In this example, the context-based reel strip 448 includes multiple star symbols 449, 450, any of which would cause a winning result (or some cases improve a winning result) on payline 446. In one embodiment, all symbols on the context-based reel strip 448 would help the result on payline 446, but may help in varying degrees, such as if all symbols were star symbols but some had different payout multipliers associated therewith. In other embodiments, the dynamically-created, context-based reel strip 448 may include just one, or some, symbols that may help the result on payline 446 (and/or other paylines). In the example reel strip 448, "some" symbols are available to help the result on payline 446, including star symbols 449 and 450, assuming that a series of five star symbols provides a winning result. Thus, in some embodiments, the system identifies 443 substitute symbol options by creating context-dependent symbols on the dynamically-generated reel strips to provide more targeted symbol possibilities for the symbol replacement.

Other representative examples are now provided of symbol populations and the dynamic, context-based triggering and/or candidate substitute symbols that may be identified during play. Example grid 445B is analyzed 441 to determine one or more places where symbol substitution would potentially benefit the result. The analysis 441 may discover that grid 445B includes at least two paylines 452, 452 that could create a winning result if a symbol was replaced. The analysis in the present example identifies symbol location 454 as a location where symbol replacement could help one or both of paylines 452, 453. In this example, in addition to symbol location 454 where symbol replacement may occur, three "7" symbols and one "wild" (W) symbol are positioned along payline 452. Further, in addition to symbol location 454 where symbol replacement may occur, three "star" symbols and one "wild" (W) symbol are positioned along payline 453. Therefore, symbol location 454 is selected as the location to provide a substitute symbol in this embodiment.

To provide this potential opportunity, candidate substitute symbols are derived based on the particular context of the paylines 452, 453. For example, the representative replacement reel strip 455 may be dynamically created to include at least one symbol that would satisfy a winning condition on one or both of paylines 452, 453, such as a star symbol, "7" symbol, or wild symbol. In this example, the context-based reel strip 455 includes one or more "7" symbols 456, 457, one or more star symbols 458, one or more wild symbols 459, and in some embodiments other symbols that would not help the outcome on either payline 452, 453. Thus, if the star symbol 458 was selected, payline 453 would be benefited as the result would be a five-star-symbol combination (including a wild symbol). If the "7" symbol 456 or 457 was selected, payline 452 would be benefited as a result would be a five-7-symbol combination (including a wild symbol). If the wild symbol 459 was selected, both paylines 452, 453 would benefit. As can be seen, by way of conducting an analysis 441 to determine a location of possible symbol replacement based on the context of the spin results, and/or by way of dynamically generating a reel strip that conforms to the situation and includes at least one symbol that would benefit that situation, the symbol replacement feature can be more targeted to the situation during play of the game.

Another example is shown at grid 445C, which is analyzed 441 to determine one or more places where symbol substitution would potentially benefit the result. The analysis 441 may discover that grid 445C includes at least two paylines 460, 461 that could create a winning result if a symbol was replaced. In one embodiment, one or both of symbol locations 462 or 463 could be the target of symbol replacement. In other embodiments, the entire reel could be considered for replacement, which would then further include symbol location 464 in the present example. In such an example, the context-based reel strip 465 could be dynamically generated to include at least one "7" symbol 466, 467, and at least one star symbol 468 to potentially assist paylines 460, 461 respectively. In one embodiment, all symbols on the reel including symbol locations 462, 463, 464 may be replaced, and the dynamically-generated reel strip 465 could be dynamically generated to include at least one pattern 469 that would cause both paylines 460, 461 to have a winning result by aligning symbols 466 and 468 on paylines 460, 461 at symbol locations 462, 463 respectively.

Still another embodiment is shown at grid 445D. This embodiment assumes a bonus initiation feature that requires 3 matching bonus symbols to initiate the bonus. Two bonus symbols 470, 471 have been presented with the initial reel spin. Assume that three aligned bonus symbols triggers a bonus, such that replacement of an existing symbol (if any) at symbol location 472 could potentially produce the third bonus symbol and initiate the bonus feature (or other feature, such as free spins, etc.). The analysis 441 can recognize that symbol substitution at symbol location 472 could improve the result, so symbol location 472 is selected as the location where a symbol replacement will be conducted. While a static reel could be used in such a situation (e.g., a predefined reel strip) as is the case in other examples of FIG. 4B, the present example assumes a dynamically-generated reel strip 473, which includes at least one bonus symbol to provide a chance to meet the bonus initiation criteria. In this example, dynamically-generated reel strip 473 includes multiple bonus symbols, including bonus symbol 474 and 475, as well as some other symbols that may not create or improve a win if selected to replace any existing symbol at symbol location 472.

FIG. 4B provides yet a further example in grid 445E, where two bonus symbols 480, 481 were randomly positioned adjacent to one another. In an example where three aligned (e.g., on a payline or otherwise) bonus symbols initiates a bonus feature, replacement of the symbol at either symbol location 482 or 483 would initiate the bonus feature, as there would be three consecutive bonus symbols as depicted by bonus symbol groups 484, 485 respectively. One embodiment may involve allowing replacement at a particular one of the symbol locations 482, 483, while other embodiments may involve allowing replacement at both of the symbol locations 482, 483. The example of FIG. 4B, grid 445E, assumes an embodiment where both symbol locations 482, 483 will be afforded an opportunity to obtain a bonus symbol to complete the requirements to initiate the bonus feature. This may be accomplished by allowing a single dynamically-generated reel 486 to be used for both symbol locations 482, 483, or as in the present example by allowing respective dynamically-generated reels 486, 487 to be used to respectively replace symbols at symbol locations 482, 483. For example, dynamically-generated reel 486 includes at least two bonus symbols 488, 489, while dynamically-generated reel 487 includes at least one bonus symbol 490. This provides multiple opportunities to obtain at least three bonus symbols to initiate the bonus feature.

In each of the instances where dynamically-generated reel strips are used in a context-dependent fashion, a symbol(s) will be randomly selected 444 from the candidate substitute symbols on the respective dynamically-generated reel strip.

Figure 5A:
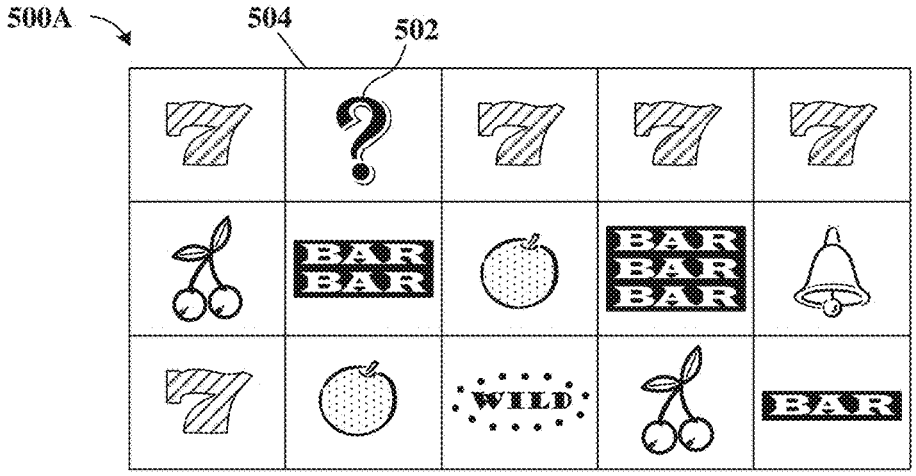
FIGS. 5A, 5B and 5C depict a succession of stages of a representative slot game depicting an embodiment of the symbol replay feature described herein.
Figure 5B:
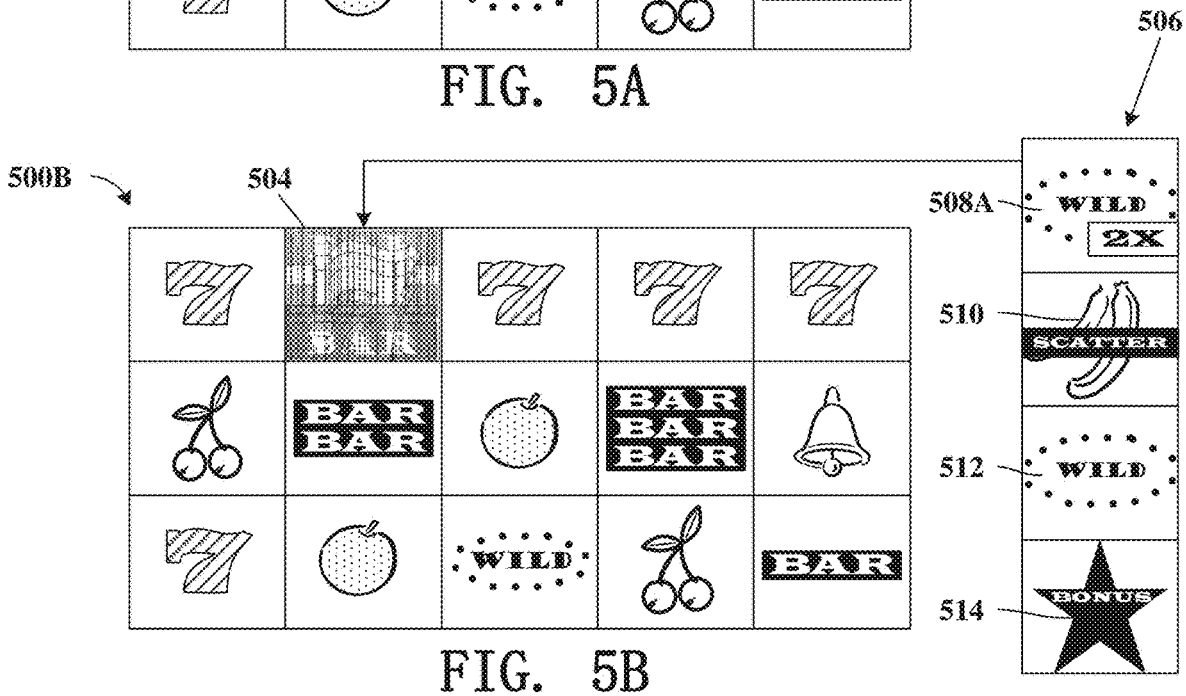
Figure 5C:
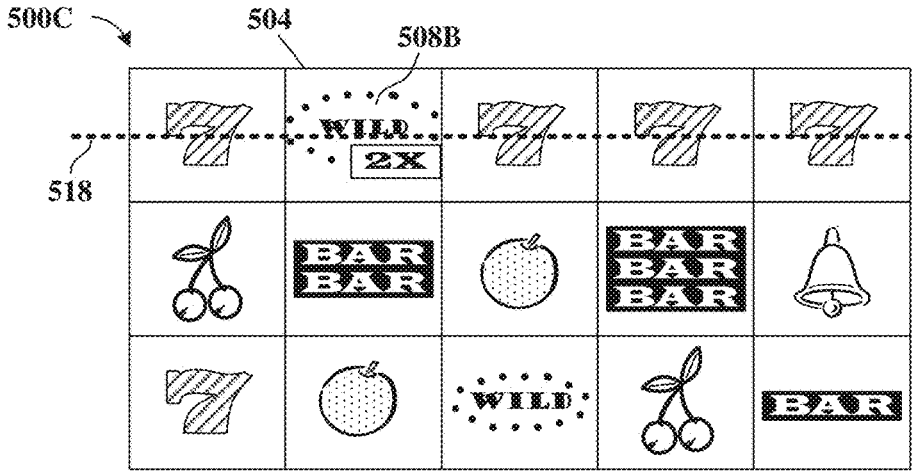

FIGS. 5A, 5B and 5C depict a succession of stages of a representative slot game depicting one embodiment of the symbol replay feature described herein. In this example, FIG. 5A shows a trigger symbol 502 that is randomly presented at a symbol location 504 of the symbol array 500A. This embodiment assumes that a condition for substituting the trigger symbol 502 with one of a plurality of candidate substitute symbols is that at least one of the candidate substitute symbols may improve the result of a payline(s). The candidate substitute symbols in the present example are shown in FIG. 5B, which shows a physical or virtual reel strip 506 that may be used as the candidate substitute symbols. In this example, the candidate substitute symbols include at least a wild symbol with a multiplier of two 508A, a scatter pay symbol 510, a standard wild symbol 512, and a bonus symbol 514.

As shown at symbol location 504 of symbol array 500B, the symbol location 504 may have the reel 506 spin (for a physical reel) or may provide the appearance of spinning or otherwise changing/transitioning (for a virtual/electronic reel), or may have a different transitional display or no transitional display at all. In one embodiment, the reel 506 is not utilized, but a random selection is ultimately made for a symbol to replace the symbol 502 at symbol location 504, regardless of the manner in which a substitute symbol is selected or presented.

Symbol array 500C of FIG. 5C shows a representative result of the random selection of one of a plurality of candidate substitute symbols on the reel 506. In this example, the symbol location 504 is populated with a new symbol 508B on payline 518 that differs from the symbol 502 (if any) originally at symbol location 504, and is a wild symbol with a 2× multiplier in this example (from the reel 506, symbol 508A). The result is a winning symbol combination (five "7" symbols with the wild symbol 508B) plus a 2× multiplier to double the ultimate payout result. In this manner, a symbol location may randomly have its initial symbol replaced with a substitute symbol from a plurality of candidate substitute symbols to potentially enhance the overall result.

Figure 6A:
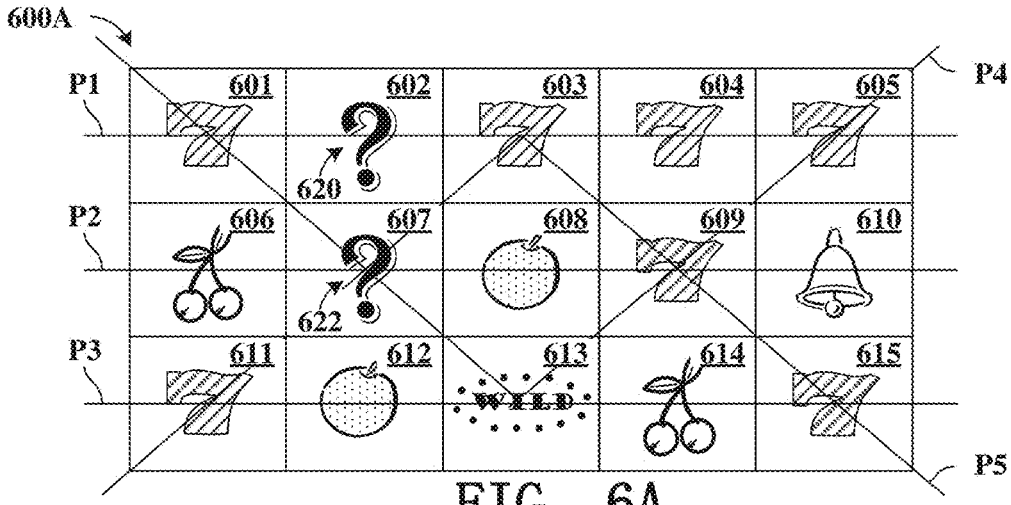
FIGS. 6A, 6B and 6C depict a succession of stages of a representative slot game depicting an embodiment of a symbol replay feature affecting multiple symbol locations.
Figure 6B:
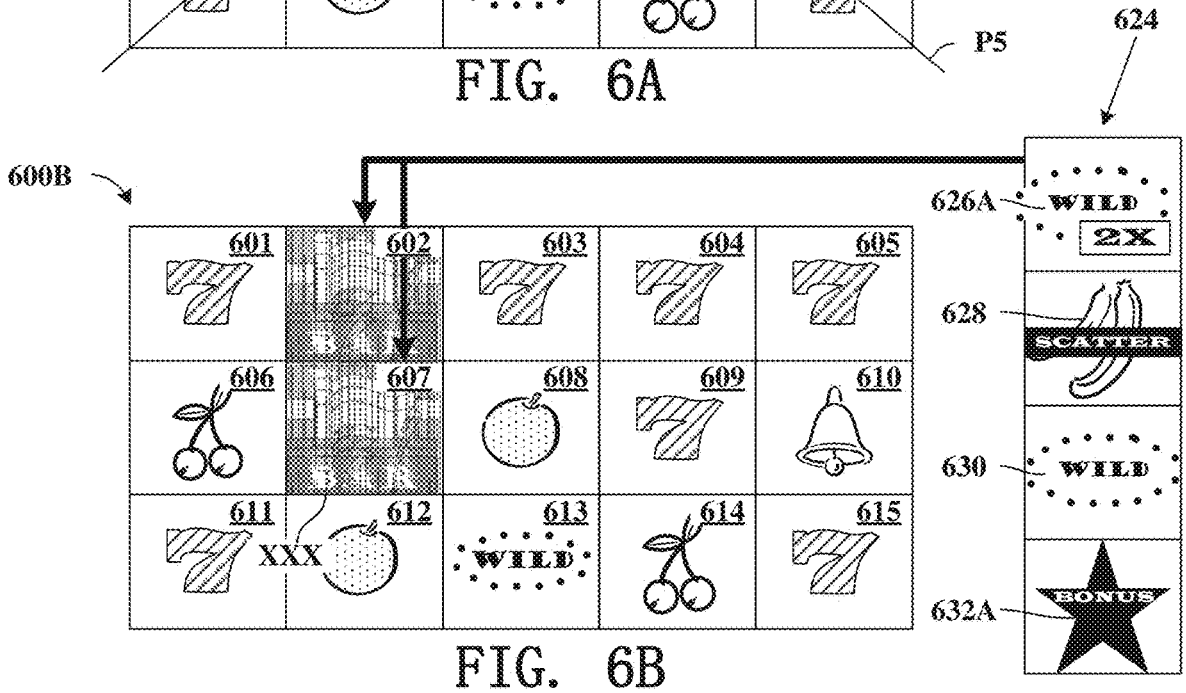
Figure 6C:
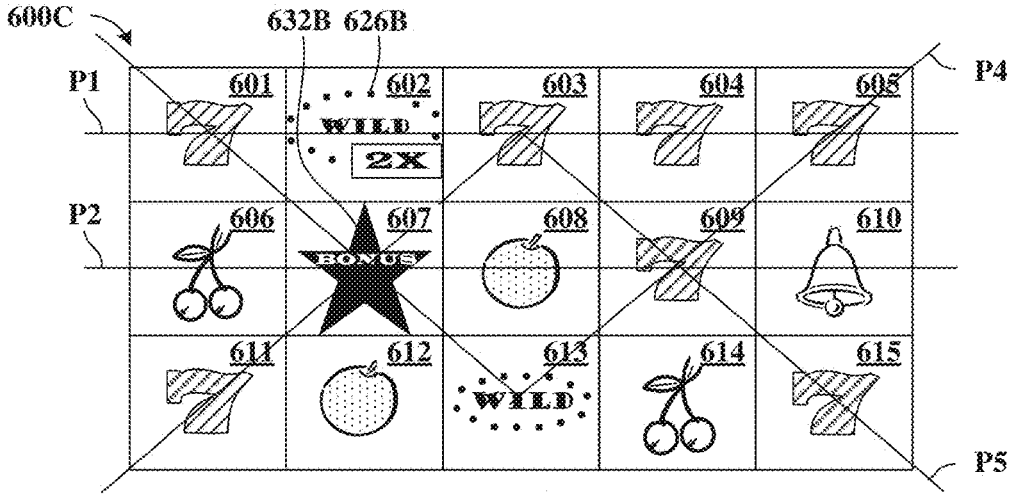

FIGS. 6A, 6B and 6C depict a succession of stages of a representative slot game depicting an embodiment of a symbol replay feature affecting multiple symbol locations. For purposes of this example, it is assumed that there are at least five paylines on which symbol combinations are analyzed for payout results, including a first payline P1 (including symbol locations 601-605), second payline P2 (including symbol locations 606-610), third payline P3 (including symbol locations 611-615), fourth payline P4 (including symbol locations 601, 607, 613, 609, 605), and fifth payline P5 (including symbol locations 611, 607, 603, 609, 615).

The gaming grid 600A of FIG. 6A shows that, in some embodiments, multiple trigger symbols 620, 622 may be randomly presented. FIG. 6A depicts these trigger symbols 620, 622 being randomly positioned at symbol locations 602, 607 respectively. This embodiment assumes that a condition for respectively substituting the trigger symbols 620, 622 with one of a plurality of candidate substitute symbols is that at least one of the candidate substitute symbols has the potential for improving the outcome of one or more of the paylines on which the associated symbol locations 602, 607 reside.

The candidate substitute symbols in the present example are shown in FIG. 6B, which shows a physical or virtual reel strip 624 that may be used as the candidate substitute symbols for both of the identified symbol locations 602, 607. In other embodiments, different reel strips (or look-up tables, etc.) may be respectively used for each of the plurality of symbol locations in which a symbol is to be replaced. In this example, the candidate substitute symbols include at least a wild symbol with a multiplier of two 626A, a scatter pay symbol 628, a standard wild symbol 630, and a bonus symbol 632A.

Symbol array 600C of FIG. 6C shows a representative result of the random selection of one of a plurality of candidate substitute symbols on the reel 624. In this example, the symbol locations 602, 607 are populated with new symbols 626B, 632B which came from selecting reel 624 symbols 626A and 632A respectively. The wild symbol 626B with 2× multiplier enables payline P1 to have a winning result, with five "7" symbols in a row, plus doubling the payout due to the 2× multiplier associated with the wild symbol 626B. On the other hand, the bonus symbol 632B does not help the ultimate result on any of the three paylines to which it is associated, namely paylines P2, P4 and P5. For example, if it is assumed that the occurrence of three bonus symbols in a row (or alternatively, anywhere in the symbol array 600C) would trigger a bonus game feature, the inclusion of the bonus symbol 632B at symbol location 607 does not result in triggering the bonus feature. If, on the other hand, either of the wild symbols 626A, 630 from the reel 624 had been selected for symbol location 607, paylines P4 and P5 would have both had winning outcomes as a result of each having five consecutive "7" symbols in view of the wild symbols serving as "7" symbols in those scenarios. In this manner, multiple symbol locations may randomly have their initial symbols replaced with substitute symbols from a plurality of candidate substitute symbols to potentially enhance the overall result.

In various embodiments, the candidate substitute symbols used may be permanently static, temporarily static, entirely random, partially random, situation-dependent where other symbols or game features influence (or even dictate) one, more or all of the symbols or type of symbols used as the candidate substitute symbols, etc. For example, a set of permanently static candidate substitute symbols may include a particular set of symbols, which may be the same symbols as the symbol set of the primary game, may be a subset of the symbols of the primary game, may include one or more symbols that are different from any in the primary game, and the like, where the set of symbols remains the same from gaming event to gaming event (e.g., from spin to spin in a slot game). One example is a subset of the set of symbols in the primary game, that include higher value symbols such as wild symbols, bonus symbols, symbols producing relatively higher payouts when a string occurs, etc. An example of a temporarily static set of candidate substitute symbols may include any symbols that remain candidate substitute symbols until some triggering event, such as a time limit, occurrence of a predetermined event(s), etc. Partially random candidate substitute symbols may include one or more unchanging symbols (or that remain the same until time time/event occurs), while one or more other symbols randomly change, or change in view of surrounding circumstances such as other symbols on the particular payline.

In another embodiment, the candidate substitute symbols may be "dynamic" in the sense that one or more of the candidate substitute symbols may adapt or otherwise conform to the particular situation at hand. For example, after the initial presentation of symbols in a slot game, the occurrence of a trigger symbol(s) among those initially-presented symbols may enable the possibility of obtaining a replacement symbol at one or more of the symbol locations. One, more or all of the candidate substitute symbols for a particular one of the trigger symbols may be dynamically selected depending on situational characteristics of the gaming event, such as the symbols already presented on the paylines involving the symbol locations where substitute symbols may be presented. More particularly, the system can identify a "gap" in an otherwise favorable payline where a payout or other award could be obtained or improved upon. For example, if three bonus symbols are required to trigger a bonus event and two bonus symbols appeared with the initial spin/symbol presentation, then at least one of the symbols in a dynamically-determined set of candidate substitute symbols may be set to a bonus symbol. A similar example could be made from scatter pay symbols, where some threshold number of scatter pay symbols gives rise to a payout. As another example, if four like symbols occur on a payline and a trigger symbol appears in the fifth location of this payline, then at least one of the symbols in a dynamically-determined set of candidate substitute symbols may be set to the same symbol to generate a winning payout for a 5-symbol win, or to improve the payout from a 4-symbol win to a 5-symbol win if applicable. In one representative embodiment, the trigger symbol(s) is randomly placed, and the surroundings are analyzed to determine whether and how the candidate substitute symbols should be created. In another representative embodiment, the symbol placement may be randomly made, and the trigger symbol is specifically, or randomly, positioned at strategic locations where such a "gap" or other relevant criteria exists.

Figure 7A:
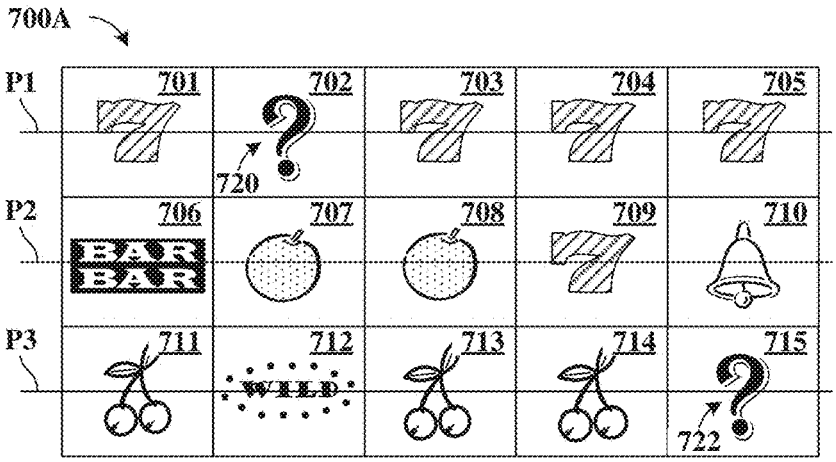
FIGS. 7A, 7B and 7C depict a succession of stages of a representative slot game depicting an embodiment of a symbol replay feature that utilizes situation-dependent or otherwise dynamic selection of candidate substitute symbols.
Figure 7B:
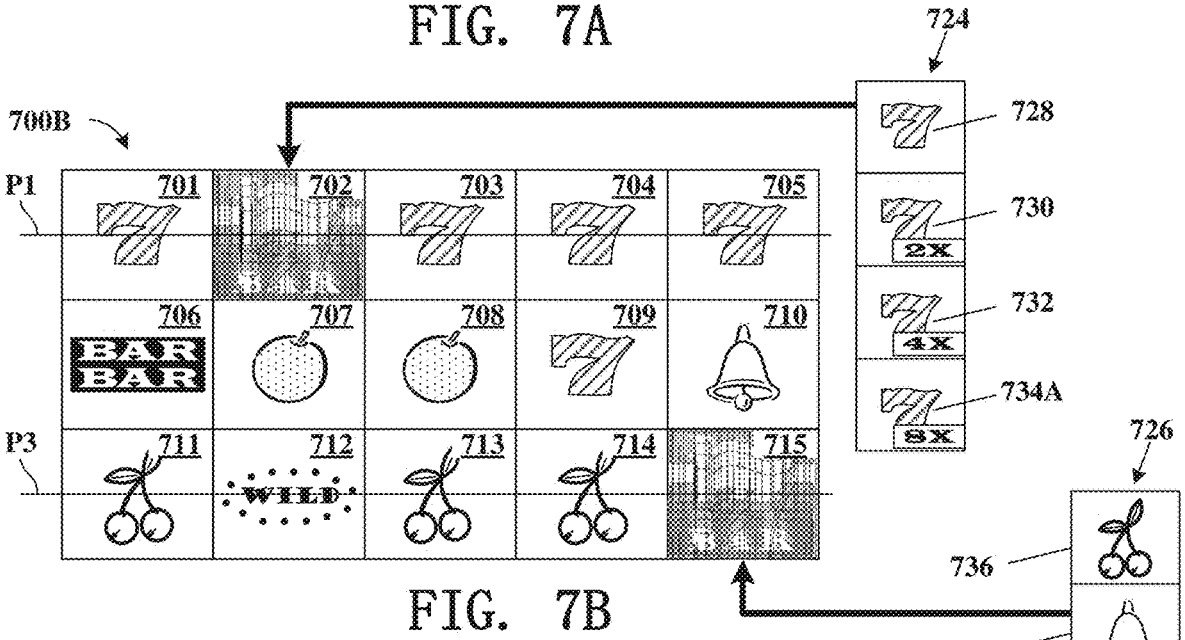
Figure 7C:
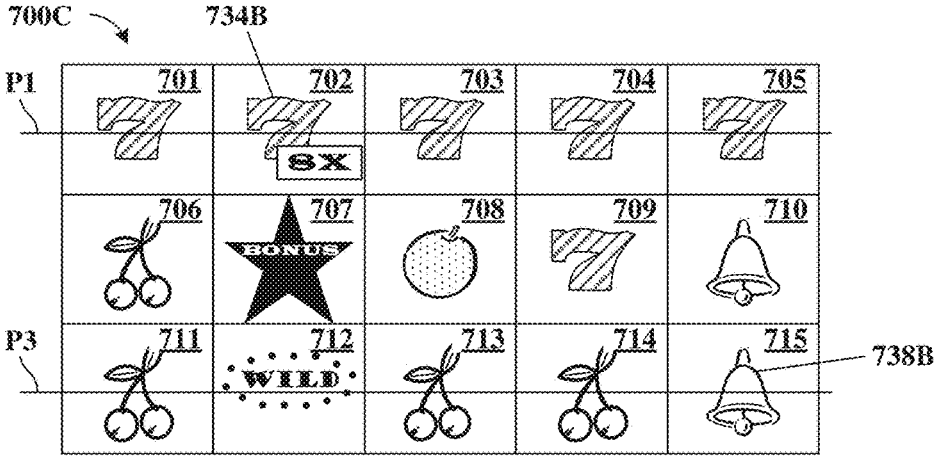

FIGS. 7A, 7B and 7C depict a succession of stages of a representative slot game depicting an embodiment of a symbol replay feature that utilizes situation-dependent or otherwise dynamic selection of candidate substitute symbols. For purposes of this example, it is assumed that there are at least three paylines on which symbol combinations are analyzed for payout results, including a first payline P1 (including symbol locations 701-705), second payline P2 (including symbol locations 706-710), and third payline P3 (including symbol locations 711-715).

FIG. 7A illustrates an embodiment where multiple trigger symbols 720, 722 may be randomly presented on play grid 700A. FIG. 7A depicts these trigger symbols 720, 722 being randomly positioned at symbol locations 702, 715 respectively. This embodiment assumes that a condition for respectively substituting the trigger symbols 720, 722 with one of a plurality of candidate substitute symbols is that at least one of the candidate substitute symbols has the potential for improving the outcome of one or more of the paylines on which the associated symbol locations 702, 715 reside.

The candidate substitute symbols in the present example are shown via grid 700B in FIG. 7B, which shows a set of candidate substitute symbols for each of the trigger symbols 720, 722 that was presented. In other embodiments, the same set of candidate substitute symbols may apply to a plurality or all of the candidate substitute symbols presented, but in the illustrated embodiment a set of candidate substitute symbols is provided for each presented trigger symbol 720, 722. In this manner, situation-dependent sets of candidate substitute symbols can be used for each of the trigger symbols 720, 722 respectively. In the illustrated embodiment, the two sets of candidate substitute symbols (one for each of the trigger symbols 720, 722) are depicted as independent reel strips 724, 726, although any substitute symbol selection methodology may be employed.

The reel strips 724, 726 (or other symbol banks) are each dynamically populated with symbols, at least in part, that are contingent on the situation or circumstances of the game or current state of the game. In one embodiment, the surrounding or otherwise relevant symbols on one, more or all paylines implicating the symbol location of a trigger symbol are examined to determine how to dynamically populate the respective reel strip.

For example, symbol location 702 is positioned on a payline P1, with like "7" symbols at symbol locations 701, 703, 704 and 705. A dynamically-generated set of candidate substitute symbols, implemented as a virtual reel strip 724 in the present example, is created with at least one symbol that would benefit the payline P1 if it was selected to populate the symbol location 702. In the example of FIG. 7B, the reel strip 724 in fact includes multiple symbols that each would benefit the payline P1 if it was selected to populate the symbol location 702. Specifically, this example involves dynamically generating the reel strip 724 with "7" symbols 728, 730, 732, 734A any of which would complete the string of "7" symbols on payline P1 that passes through symbol locations 701-705. Thus, the reel strip 724 includes at least one "7" symbol because the situation or state of the game, which is that payline P1 is close to a winning payout with "7" symbols, would benefit from a "7" symbol at symbol location 702.

In this embodiment, each of the dynamically-generated "7" symbols differs in some way, such as including a payout modifier (e.g., multiplier) with one or more of the symbols. Representative reel strip 724 includes a "7" symbol 728 with no multiplier, a "7" symbol 730 with a 2× multiplier, a "7" symbol 732 with a 4× multiplier, and a "7" symbol 734A with a 8× multiplier. More symbols may also be associated with such a reel strip 724, but for purposes of this example there are four selectable candidate substitute symbols.

A random selection of one of the symbols 728, 730, 732, 734A is made. The selected symbol is presented at symbol location 702, which is the symbol location designated initially for potential symbol substitution (e.g., with the presence of a trigger symbol therein). As depicted via grid 700C of FIG. 7C, selection of symbol 734A from reel strip 724 causes that symbol to be positioned at symbol location 702, as depicted by symbol 734B, thereby completing the payline P1 with a string of five "7" symbols which provides a payout.

In one embodiment, the candidate substitute symbols for multiple trigger symbols occurring for a gaming event may be the same for each symbol location, or may be different. In the situation-dependent embodiment of FIGS. 7A-7C, each symbol location that is available for symbol replacement uses a set of candidate substitute symbols that depends on the gaming situation (e.g., what other symbols are presented on the symbol array/grid and what results are possible).

For example, symbol location 715 is positioned on a payline P3, with like cherry symbols at symbol locations 711, 713 and 714, and a wild symbol (which can serve as a cherry symbol) at symbol location 712. A dynamically-generated set of candidate substitute symbols, implemented as a virtual reel strip 726 in the present example, is created with at least one symbol that would benefit the payline P3 if it was selected to populate the symbol location 715. In the example of FIG. 7B, the reel strip 726 includes multiple symbols that each would benefit the payline P3 if it was selected to populate the symbol location 715. Specifically, this example involves dynamically generating the reel strip 726 with a cherry symbol 736 and a cherry symbol 740 with a modifier associated therewith (e.g., 5× multiplier), as well as other symbols 738, 742 that would not benefit any result or payout on payline P3 of FIG. 7B.

In this embodiment, a random selection of one of the symbols 736, 738A, 740, 742 is made. The selected symbol is presented at symbol location 715, which is one of the symbol locations designated initially for potential symbol substitution (e.g., with the presence of a trigger symbol therein). As depicted in FIG. 7C, random selection of symbol 738A from reel strip 726 causes that symbol to be positioned at symbol location 715, thereby completing the payline P3. In this example, the "bell" symbol 738B does not cause a winning result where a string of five consecutive cherry symbols is needed for a winning result, nor does it cause an improved result where a lesser number (e.g., three or four) consecutive cherry symbols may already constitute a winning result. Thus, this example illustrates that some embodiments will not result in a more favorable result than was available prior to the symbol replay/respin feature, but there is at least a chance of an improved result. In still other embodiments, the symbols on the replacement reel(s) 724, 726 may be completely random, where none, one, some, or all of the symbols thereon may be capable of causing or improving a result on a relevant payline.

In one embodiment, different reel strips 724, 726 are used for each respective symbol location 702, 715 at play. In other embodiments, a single reel strip (e.g., reel strip 724) may be used for a plurality of symbol locations 702, 715 where trigger symbols occurred. In other embodiments, multiple paylines may pass through a single symbol location that is identified for possible substitution. In such a case, if more than one candidate substitute symbol would better the result on one or more of the paylines, then one, more, or all of the candidate substitute symbols that could better any of the paylines may be included as the set of candidate substitute symbols. In other embodiments, a symbol that would best help multiple ones of the paylines involving the triggered symbol location may be included as a candidate substitute symbol.

Figure 8:
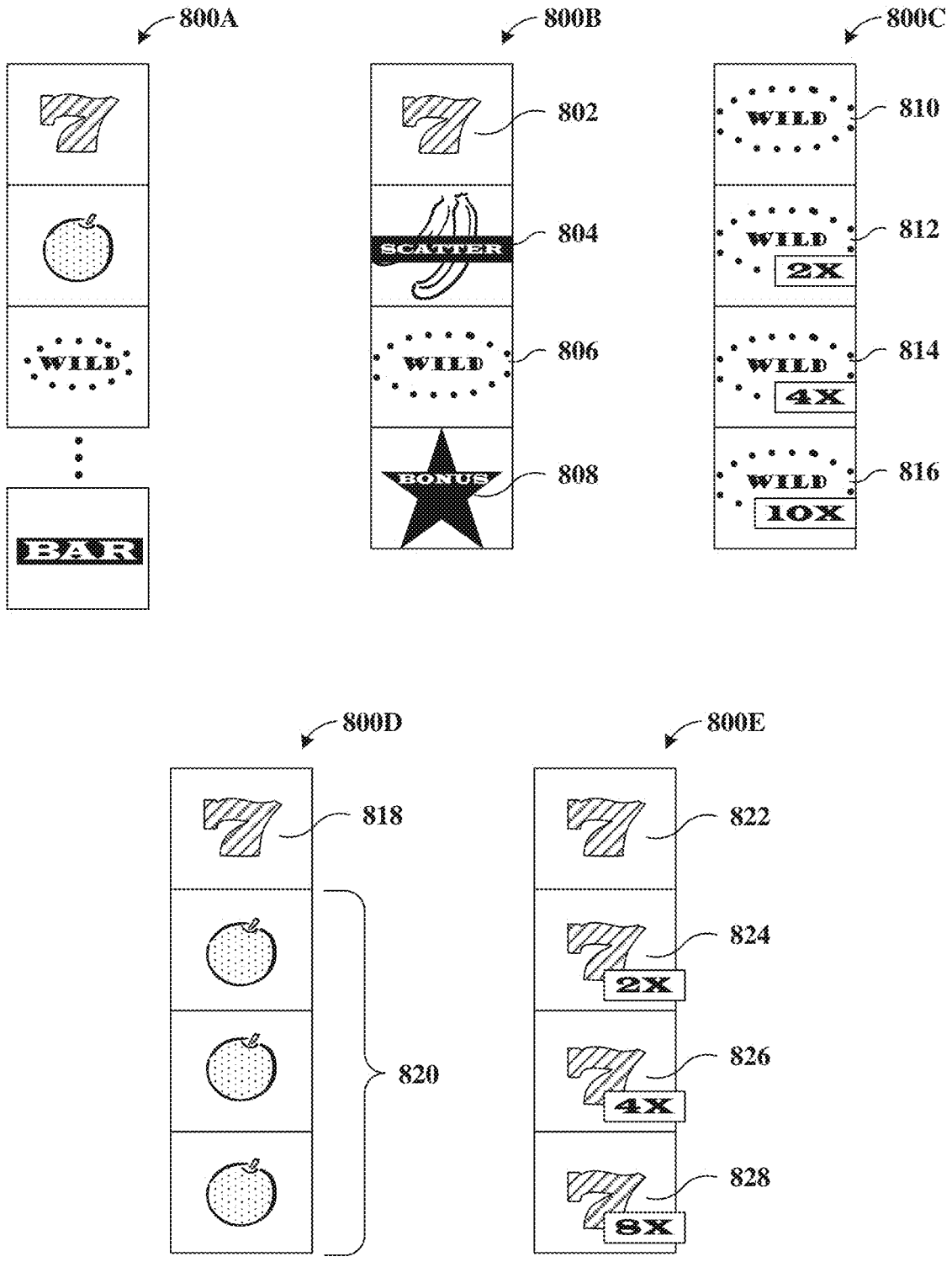
FIG. 8 depicts some representative replacement reels used at a symbol location(s) that is designed for replay.

As noted above, the present disclosure contemplates a variety of different types of candidate substitute symbols, depending on the desired game functionality. The candidate substitute symbols used may be permanently static, temporarily static, entirely random, partially random, situation-dependent where other symbols or game features influence or dictate one, more or all of the symbols or type of symbols used as the candidate substitute symbols, etc. FIG. 8 depicts some representative replacement reels used at a symbol location(s) that is designed for replay (e.g., with a trigger symbol or other symbol location identifier). The exemplary replacement reels depicted in FIG. 8 are provided for purposes of example, and do not represent an exhaustive list of the types of replacement reels or the symbols provided thereon. The replacement reels described in this disclosure may include any number of symbols (as depicted by the indeterminate number of symbol locations on reel 800A), but are shown as four-symbol reels for purposes of illustration and explanation.

In the example of FIG. 8, representative reel 800A depicts a reel that is populated with random symbols. The symbols may be entirely from the set of symbols in the primary slot game, or may include one, more or all new symbols that are not part of the primary game. The symbols on the reel 800A may be randomly selected each time a trigger symbol is presented, or may remain static over some time or number of trigger symbol occurrences, or may remain static during the entire game play, etc. In one embodiment, the replacement reel 800A includes at least one symbol that has a relatively high value, such as a wild symbol, symbol associated with the highest payout, bonus symbol, free spin symbol, etc., or in situation-dependent embodiments includes at least one symbol that is known to cause a winning result or improve an existing winning result if selected.

Reel 800B depicts another example, where a set of symbols is permanently associated (or at least over some time or number of gaming events) with the replacement reel. In one embodiment, the symbols on such reel 800B are relatively high value symbols, such as a top paying symbol 802 (i.e. the symbol associated with the top paying, or high paying, award), a scatter pay symbol 804, wild symbol 806, bonus symbol 808, etc.

In another embodiment, all of the symbols on the reel may be symbols that will improve the result, whether symbols known to provide a chance to win or improve on a payline, or whether in a situation-dependent embodiment. For example, exemplary reel 800C includes four wild symbols, each with different modifiers associated therewith. Specifically, wild symbol 810 has no multiplier, while wild symbols 812, 814 and 816 are associated with 2×, 4× and 10× multipliers respectively.

Another exemplary reel 800D depicts a situation-dependent scenario, where it may be determined that a particular symbol would help to win or improve a payout on a payline. For example, a "7" symbol 818 may be a symbol that would fill a gap in a sequence of "7" symbols, such that if the "7" symbol 818 was selected, a payout would be won or increased if the "7" symbol 818 is selected. Other symbols 820 may or may not ultimately help to win or improve a payout on a payline, and may be static or dynamically changed.

Reel 800E depicts another example, where the context or situation is analyzed at a symbol location identified by a trigger symbol or other identifier, and the reel 800E is dynamically generated with at least one symbol that would benefit the payline(s) associated with that symbol location. In this example, it is assumed that a plurality of "7" symbols are present on at least one payline involving a symbol location having a trigger symbol or other indicator. In one embodiment, as few as one "7" symbols, and/or wild symbols, and/or other situation-beneficial symbols are provided on the reel 800E. In another embodiment, such as that shown via reel 800E, all symbols 822, 824, 826, 828, etc. on reel 800E are beneficial to the implicated payline(s). As in the example of FIG. 8, any one or more of the like symbols 822, 824, 826, 828, etc. may be distinguished by other characteristics, such as an associated payout modifier. In this example, exemplary reel 800E includes four "7" symbols, each with different modifiers associated therewith. Specifically, "7" symbol 822 has no multiplier, while "7" symbols 824, 826 and 828 are associated with 2×, 4× and 8× multipliers respectively.

The representative reel strips, and their dynamic or static nature and other criteria for populating the replacement reel strip, are depicted for purposes of illustration. These do not represent an exhaustive list, as the criteria for populating replacement reels may be implemented in a variety of manners understandable by those of ordinary skill in the art from the teachings provided herein.

Figure 9:
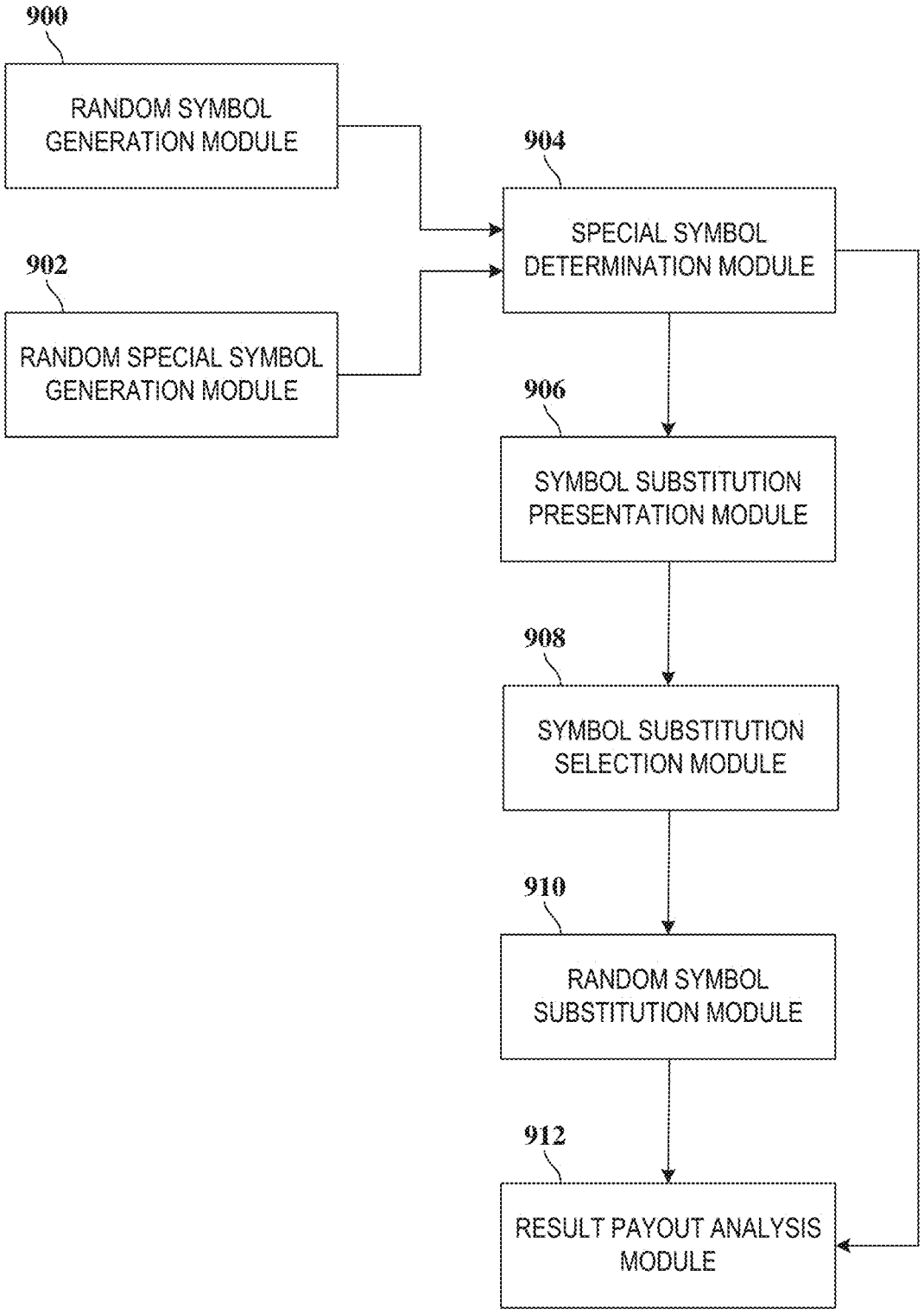
FIG. 9 depicts an embodiment where a processing arrangement is programmed to provide various modules for performing the conditional gaming replay functions described herein.

As previously noted, the functionality provided herein may be implemented in hardware on computing devices ranging from large gaming systems, stand-alone kiosks, to small personal devices. FIG. 9 depicts a slot game embodiment where a processing arrangement (which is intended to include single processors, multiple processors, or any other processing arrangement) is programmed with software and/or firmware to provide various modules to perform functions described herein. The principles in FIG. 9 are equally applicable to games other than slot games, such as poker or other card games, bingo, roulette, craps, or other games where a result could be replayed in a video/electronic context or properly configured physical implementations. In the representative example of FIG. 9, each of the modules represents software-programmed or otherwise designed/configured hardware to carry out functions to facilitate the gaming features described herein.

A random symbol generation module 900 represents a module to create an initial state of the game, such as populating a symbol array with symbols in a slot game. This random symbol generation may, in some instances, provide one or more trigger symbols or other symbol location indicators to identify one or more symbol locations that will become candidates for substitute symbols. Generation of such special symbol or other triggering event is depicted by the random special symbol generation module 902, which may be a separate module, or may be integrated into the random symbol generation module 900 with one or more symbols to identify a candidate symbol location(s). The special symbol determination module 904 detects which symbol location(s) that a special symbol (i.e. triggering symbol) or other symbol location identifier is associated with. In one embodiment, the special symbol determination module 904 may be integral to module 900 and/or 902 such that it is aware of whether and which special symbol(s) has been presented upon its generation. If the particular gaming event (e.g., reel spin) did not result in any special symbol or other symbol location identifier identifying a position for a substitute symbol, the gaming event carries on normally in one embodiment, where the result payout analysis module 912 determines whether any paylines or other game features results in a win and consequent payout to the player based on the originally presented symbol state.

On the other hand, if the particular reel spin did result in the presentation of a special symbol (or other symbol location identifier) specifying a position for a substitute symbol, then the particular symbol location at which it occurred is recognized by the gaming system/apparatus. For example, at the designated symbol location(s), the symbol substitution presentation module 906 may optionally provide a visual presentation indicating that the symbol is to be replaced, such as the appearance of a spinning independent reel at that symbol location(s). The symbol substitution selection module 908 selects a substitute symbol from a plurality of candidate substitute symbols, and the random symbol substitution module 910 substitutes the newly selected symbol at the identified symbol location(s). When the substitute symbol(s) has been positioned in the respective symbol location(s) on the symbol grid, the result payout analysis module 912 determines the result on the relevant payline(s) (or at the relevant gaming element in non-slot games), and enables the award to be made available to the participant.

Numerous variations are possible in view of these and other embodiments of the inventive concept. Numerous embodiments have been described in connection with a slot embodiment, although many other embodiments and variations exist that are covered by the principles and scope of this concept. The principles described herein are equally applicable to different games, such as other types of slot games, poker games, roulette, bingo, or other games of chance. The principles are also applicable to gaming features, such as bonus events. For example, a bonus event may involve spinning a wheel(s) to identify some award, where wheel values, portions, additional features, and the like may be substituted into the wheel prizes in the manners described herein. As an example of another type of game that can implement the principles described herein, FIG. 10 depicts a representative poker game that utilizes a card(s) substitution feature as described herein.

Figure 10:
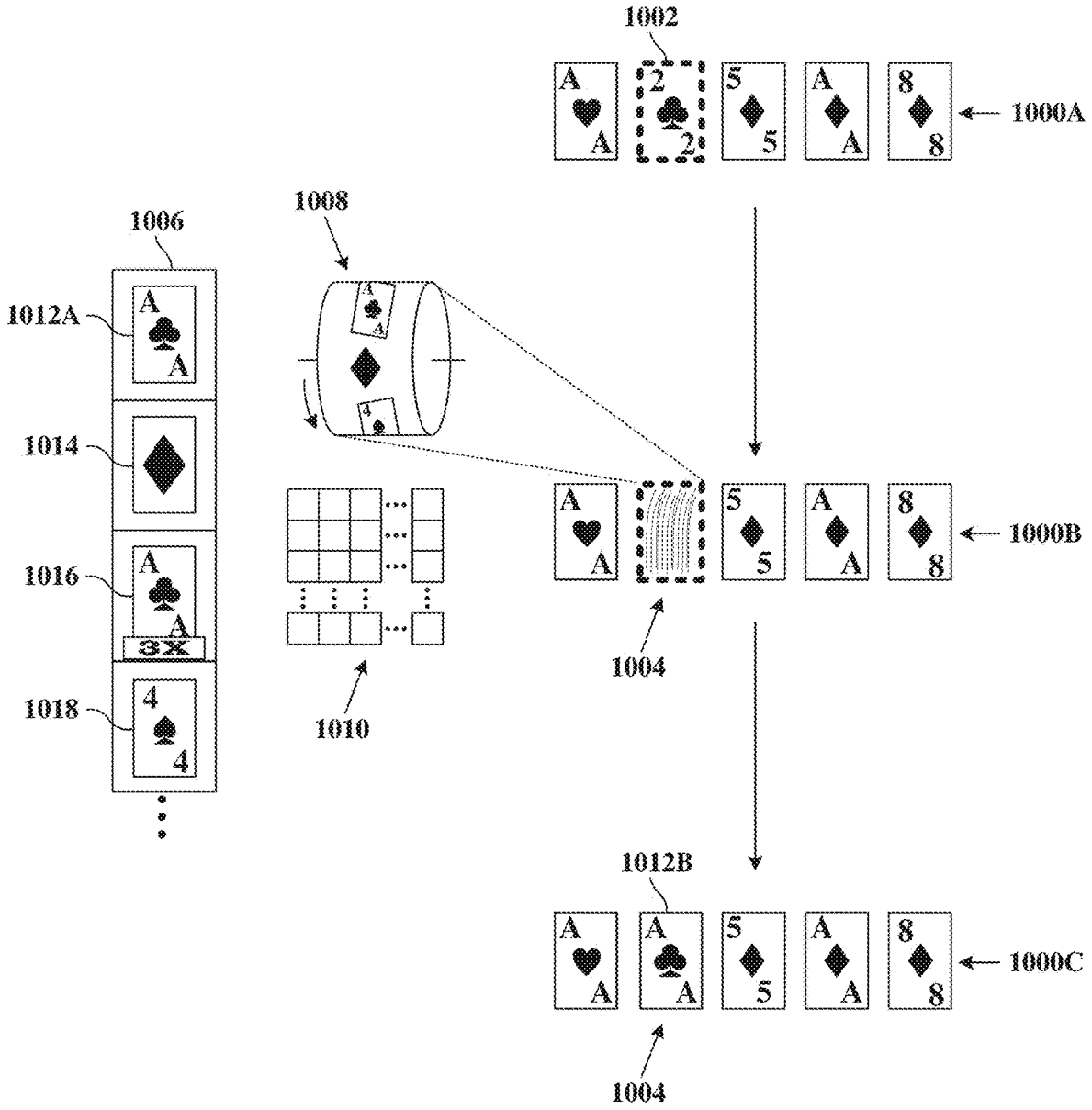
FIG. 10 depicts a representative poker game that utilizes a card(s) substitution feature as described herein.

FIG. 10 illustrates a poker embodiment where at least one hand 1000A of cards is available to the player. The poker game may be a stud poker game, draw poker game, hold'em poker game, etc. The hand 1000A may be an initially dealt hand, an intermediate hand, or a final hand. For example, in the context of a five-card stud poker game, hand 1000A represents the initial hand and the final hand, as they are one in the same. In a seven-card stud poker game, hand 1000A may represent the final hand which is the best five of the seven cards dealt. In a draw poker game, the hand 1000A may represent the initial dealt hand, or a post-draw hand. The principles described herein may be implemented on one or more cards of the poker hand(s) played regardless of the stage of the game.

In this example, one or more of the cards 1002 is designated as a candidate for replacement. The candidate card may be designated as a special symbol, such as a symbol on the card that does not otherwise belong to the standard 52-card deck used in poker (e.g., a joker card, a special card with special indicia, etc.). In other embodiments, the candidate card is highlighted in some manner, such as depicted by the dashed line around card 1002 in hand 1000A. Thus, card 1002 is a candidate for replacement. In one embodiment, it is first determined whether changing the card to some other card could cause a winning hand or provide a higher winning hand. If such condition is met (or automatically if no such condition is implemented), the card 1002 may then be replaced. In one embodiment, a visual transition state may be presented as shown at card location 1004 where card 1002 was previously dealt.

In one embodiment, a plurality of candidate substitute card symbols are made available as possible substitution symbols for the card being replaced. This may be accomplished in any desired fashion as previously described, including but not limited to a multi-symbol (i.e. multi-card) reel strip 1006 which may or may not be associated with a physical or virtual reel 1008, a look-up table 1010, etc. As described in previous embodiments, the reel strip 1006 and/or reel 1008, available look-up table 1010 values, etc. may include at least one card symbol that could create or improve a winning result. Alternatively, multiple or even all symbols of the candidate substitute card symbols may create or improve a winning result, and such candidate substitute card symbols may be static, dynamic, and/or have any other characteristics described herein.

In the present example, the candidate substitute card symbols include an Ace of Clubs 1012A, Diamond 1014 (which represents any diamond card), Ace of Clubs 1016 with a 3× multiplier, and a Four of Spades 1018. In this embodiment, multiple symbols of the reel strip 1006 could create or improve a final hand. For example, either the Ace of Clubs 1012A or Ace of Clubs 1016 with a 3× multiplier, if selected, would result in three Aces in the final hand 1000C. The Diamond symbol 1014, which represents any diamond card, could be used to assist in creating a flush of diamonds, but is not helpful to a final result in this example. Similarly, the Four of Spades 1018, if selected, would not help to create or improve a final hand.

In this example, it is assumed that the Ace of Clubs 1012A symbol/card was randomly selected among the plurality of cards associated with the reel strip 1006. This is depicted as the Ace of Clubs 1012B at card location 1004 in final hand 1000C. The hand was therefore improved from a pair of Aces to three Aces, which in most poker implementations results in a higher payout. As this example illustrates, the principles described herein are equally applicable to poker and other games of chance.

Figure 11A:
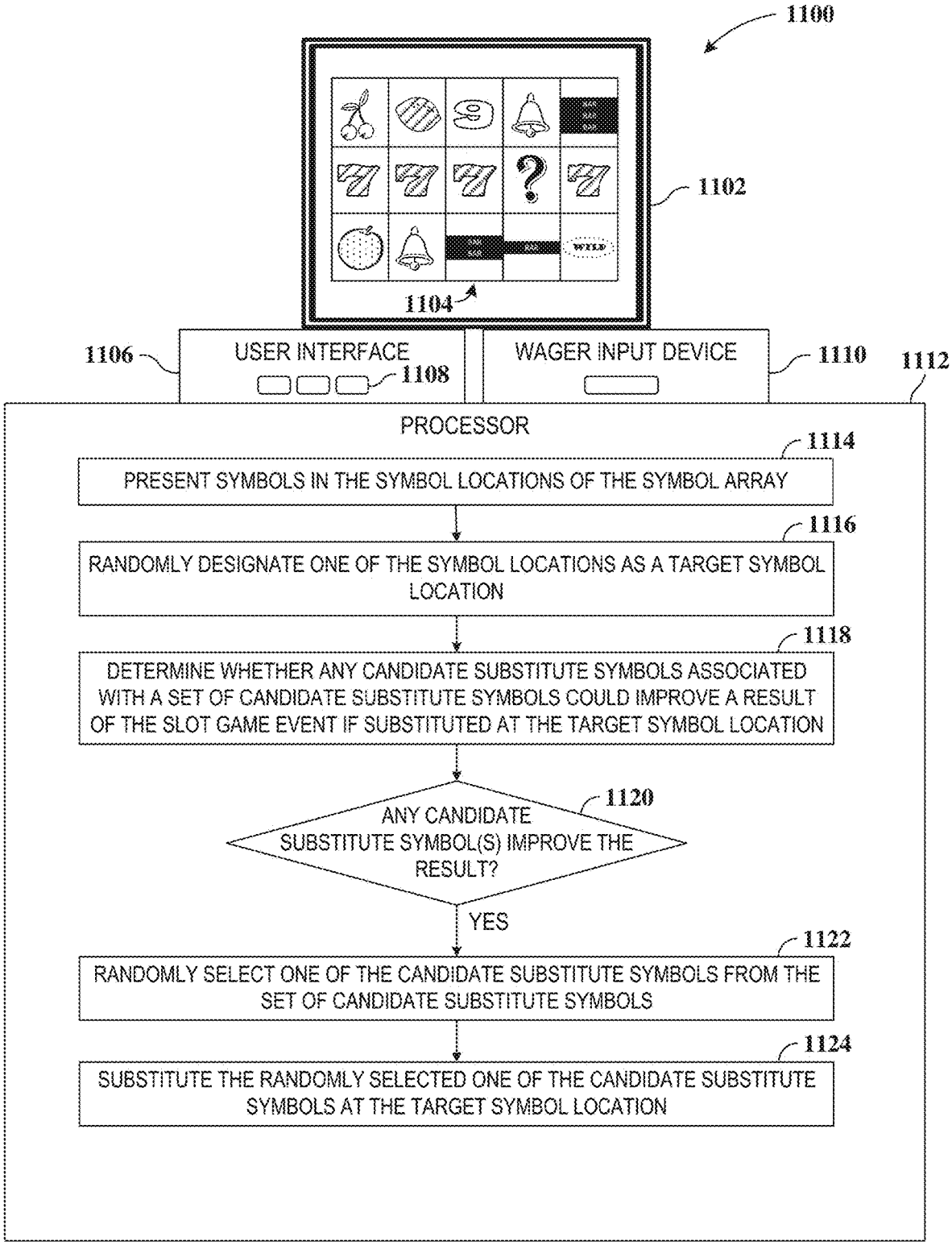
FIGS. 11A and 11B are block diagrams of representative slot game apparatuses for conditionally substituting slot game symbols.

FIG. 11A is a block diagram of a representative slot game apparatus for conditionally substituting slot game symbols in accordance with one embodiment. A slot game device 1100 is provided on which players can play slot games. The representative slot game device includes at least a display 1102 presenting a slot game symbol array or "grid" 1104 of symbol locations, a user interface 1106 including at least one user input 1108 to enable a player to initiate a slot game event presented via the slot game grid 1104, and a wager input device 1110 structured to identify and validate player assets and ultimately permit the player to play the slot game event when the player assets are provided. The slot game device 1100 also includes a processor 1112 configured to present 1114 symbols in the symbol locations of the symbol array, and randomly designate 1116 one of the symbol locations as a target symbol location. The symbols presented may include any symbols or other indicia used in the game, including blank symbols. More than one symbol location may be designated as a target symbol location, and an analogous process would be applied to each one. It is determined 1118 whether any candidate substitute symbols associated with a set of the candidate substitute symbols could improve a result of the slot game event if substituted at the target symbol location. If so, as determined at decision block 1120, one of the candidate substitute symbols is randomly selected 1122 from the set of candidate substitute symbols, and the randomly selected candidate substitute symbol is substituted 1124 at the target symbol location.

Figure 11B:
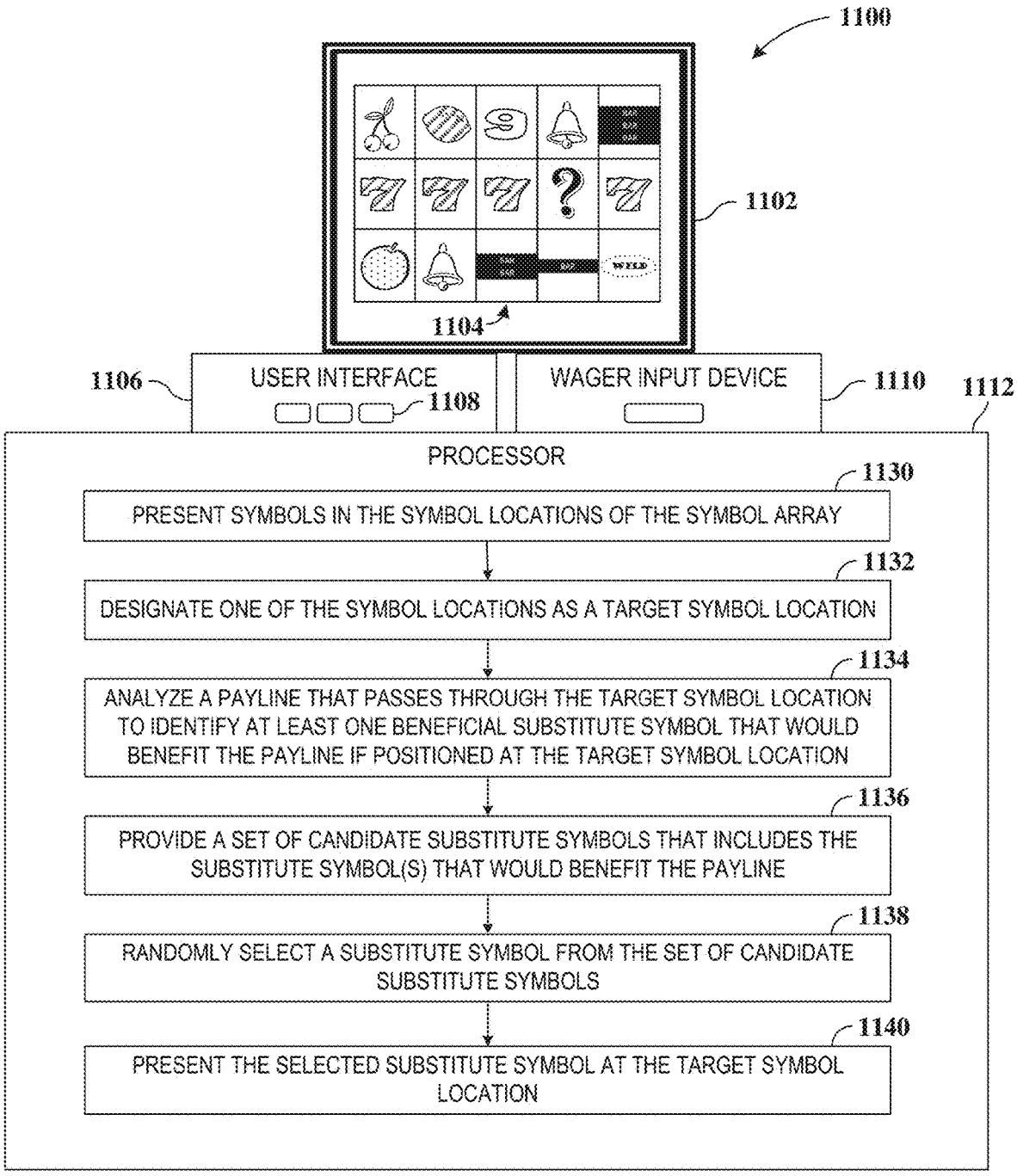

FIG. 11B is a block diagram of another representative slot game apparatus for conditionally substituting slot game symbols, where the substitutable symbol location and candidate substitute symbols are based on the context or situation of the particular gaming event. The display 1102, symbol array 1104, user interface 1106, user input 1108, wager input device 1110 and processor 1112 are analogous to that described in connection with FIG. 11A, and therefore like reference symbols are used. The processor 1112 is configured to present 1130 symbols in the symbol locations of the symbol array, and to designate 1132 one of the symbol locations as a target symbol location. It should be recognized that more than one of the symbol locations may be designated for replacement by the same or different sets of candidate substitute symbols, and by designating "one" it includes at least one. The processor is further configured to analyze 1134 a payline that passes through the target symbol location to identify at least one beneficial substitute symbol that would benefit the payline if positioned at the target symbol location, and to provide 1136 a set of candidate substitute symbols that includes the substitute symbol(s) that would benefit the payline. It should be recognized that multiple paylines may be involved, and one, more or all of the paylines may be considered when providing 1136 the set of candidate substitute symbols. The processor further randomly selects 1138 at least one substitute symbol from the set of candidate substitute symbols, and presents 1140 the selected substitute symbol at the target symbol location. The payline may then be analyzed to determine an outcome considering the substitution.

In some embodiments, the symbols are presented 1130, and the game grid 1104 is analyzed to identify one or more symbol combinations on respective paylines that may have a "near miss" such that changing a symbol at a symbol location on that payline could benefit the final outcome. In such an embodiment, this analysis is performed, and then that identified symbol location is designated as the target symbol location and available to receive a substitute symbol. The candidate substitute symbols in such case can be determined from the context of the available payline(s), so that at least one (and in some cases all) of the candidate substitute symbols can cause a winning payout or increase a winning payout, thereby creating a situation-dependent selection.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game device comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor coupled at least to the display and the user interface, and configured to:

present symbols by way of the display in the symbol locations of the symbol array;

randomly designate one of the symbol locations as a target symbol location, and identify the randomly designated one of the symbol locations via the display;

determine whether any candidate substitute symbols associated with a set of the candidate substitute symbols could improve a result of the slot game event if substituted at the target symbol location;

randomly select one of the candidate substitute symbols from the set of candidate substitute symbols if it is determined that any of the candidate substitute symbols could improve the result;

substitute the randomly selected one of the candidate substitute symbols at the target symbol location; and cause the display to present the randomly selected one of the candidate substitute symbols at the target symbol location.

2. The slot game device of claim 1, wherein the processor is further configured to determine the result of the slot game event by analyzing combinations of the symbols and the randomly selected one of the candidate substitute symbols on one or more paylines that involve the target symbol location.

3. The slot game device of claim 1, wherein the processor is configured to determine whether any of the candidate substitute symbols could improve the result of the slot game event by determining whether any of the candidate substitute symbols, if substituted at the target symbol location, would change a first symbol combination that does not correspond to a predetermined winning symbol combination to a second symbol combination that does correspond to a predetermined winning symbol combination.

4. The slot game device of claim 1, wherein the processor is configured to determine whether any of the candidate substitute symbols could improve the result of the slot game event by determining whether any of the candidate substitute symbols, if substituted at the target symbol location, would change a first symbol combination that corresponds to a first predetermined winning symbol combination having a first payout value to a second symbol combination that corresponds to a second predetermined winning symbol combination having a second payout value higher than the first payout value.

5. The slot game device of claim 1, wherein the processor is configured to randomly designate one of the symbol locations as a target symbol location by presenting via the display a predefined symbol at the target symbol location.

6. The slot game device of claim 1, wherein the processor is configured to randomly designate one of the symbol locations as a target symbol location by distinguishing the target symbol location from other ones of the symbol locations.

7. The slot game device of claim 1, wherein the processor is configured to create the set of the candidate substitute symbols as a static set of the candidate substitute symbols that does not change between slot game events.

8. The slot game device of claim 1, wherein the processor is configured to randomly create the set of the candidate substitute symbols anew for each of a plurality of the slot game events.

9. The slot game device of claim 1, wherein the processor is further configured to:

randomly designate at least one additional one of the symbol locations as additional target symbol locations;

determine whether any candidate substitute symbols associated with the set of the candidate substitute symbols could improve additional results of the slot game event if substituted at the respective additional target symbol locations;

for each of the additional target symbol locations, randomly select one of the candidate substitute symbols from the set of candidate substitute symbols if it is determined that any of the candidate substitute symbols could improve the additional results; and substitute the randomly selected ones of the candidate substitute symbols at the respective ones of the target symbol locations.

10. A slot game device comprising:

a display presenting a plurality of symbol locations forming a symbol array;

a user interface including at least one user input to enable a player to initiate a slot game event presented via the symbol array;

a wager input device structured to identify and validate player assets, and to permit the player to play the slot game event when the player assets are provided; and a processor coupled at least to the display and the user interface, and configured to:

present symbols in the symbol locations of the symbol array via the display;

designate one of the symbol locations as a target symbol location, and cause the display to identify the designated one of the symbol locations as the target symbol location;

analyze a payline that passes through the target symbol location to identify at least one substitute symbol that would benefit the payline if positioned at the target symbol location;

provide a set of candidate substitute symbols that includes the at least one substitute symbol that would benefit the payline;

randomly select a substitute symbol from the set of candidate substitute symbols;

present, by way of the display, the selected substitute symbol at the target symbol location; and analyze the payline to determine an outcome.

11. The slot game device of claim 10, wherein designating one of the symbol locations comprises randomly designating one of the symbol locations as the target symbol location.

12. The slot game device of claim 10, wherein designating one of the symbol locations comprises analyzing the symbols on the symbol array to identify a group of the symbols on the payline that need one more of the symbols on a particular one of the symbol locations to create or increase a payout on the payline, and designating the particular one of the symbol locations as the target symbol location.

13. The slot game device of claim 10, wherein the processor is configured to:

analyze the payline by analyzing a plurality of paylines that pass through the target symbol location to identify at least one substitute symbol that would benefit one or more of the plurality of paylines if positioned at the target symbol location; and provide a set of candidate substitute symbols by providing the set of candidate substitute symbols that includes the at least one substitute symbol that would benefit one or more of the plurality of paylines.

14. The slot game device of claim 10, wherein the processor is configured to provide the set of candidate substitute symbols by providing at least one of the candidate substitute symbols that would cause the outcome to change from non-winning outcome to a winning outcome.

15. The slot game device of claim 10, wherein the processor is configured to provide the set of candidate substitute symbols by providing at least one of the candidate substitute symbols that would cause the outcome to change from first level result to a second level result, where the second level result has a higher monetary value than the first level result.

16. The slot game device of claim 10, wherein the processor is configured to analyze the payline by comparing predetermined winning symbol combinations to symbols on the payline, and to identify one or more candidate substitute symbols that would complete any of the predetermined winning symbol combinations.

17. The slot game device of claim 10, wherein the processor is configured to designate a designating a target symbol location comprises presenting a special symbol at the target symbol location.

* * * * *